US010207773B2

(12) United States Patent
Betcher

(10) Patent No.: US 10,207,773 B2
(45) Date of Patent: Feb. 19, 2019

(54) CORROSION-AND-CHAFING-RESISTANT, BUOY SYSTEM AND METHOD

(71) Applicant: Christopher Betcher, Deer Harbor, WA (US)

(72) Inventor: Christopher Betcher, Deer Harbor, WA (US)

( * ) Notice: Subject to any disclaimer, the term of this patent is extended or adjusted under 35 U.S.C. 154(b) by 63 days.

(21) Appl. No.: 15/459,587

(22) Filed: Mar. 15, 2017

(65) Prior Publication Data

US 2017/0190387 A1 Jul. 6, 2017

Related U.S. Application Data

(62) Division of application No. 14/267,612, filed on May 1, 2014, now abandoned.

(51) Int. Cl.
*B63B 22/18* (2006.01)
*B63B 21/26* (2006.01)
(Continued)

(52) U.S. Cl.
CPC ..... *B63B 21/26* (2013.01); *B63B 22/02* (2013.01); *B63B 22/04* (2013.01); *E21B 7/185* (2013.01);
(Continued)

(58) Field of Classification Search
CPC ..... B63B 21/24; B63B 21/26; B63B 22/02; B63B 22/04; B63B 22/16; B63B 22/24;
(Continued)

(56) References Cited

U.S. PATENT DOCUMENTS 227,483 A 5/1880 Case
436,644 A 9/1890 White
(Continued)

FOREIGN PATENT DOCUMENTS

CN 102900050 A 1/2013
DE 202011103513 U1 1/2014
(Continued)

OTHER PUBLICATIONS

Boat Moorings, Helix Moorings, http://www.boatmoorings.com/hm.php, webpage, Aug. 7, 2014.
(Continued)

*Primary Examiner* — Daniel V Venne
(74) *Attorney, Agent, or Firm* — Pate Baird, PLLC

(57) ABSTRACT

A buoy and mooring system provides a robust buoy protective of markings thereon, easily retrieved for inspection and service, weighted and levered for maintaining self-righting, vertical orientation and anchored with a non-corroding system of connectors and links running from surface to sea floor. A mid-line float resists entanglement, and can be installed or uninstalled by operation of various "worm grip" mechanisms. A slack line region accommodates changing tides. An upright tube, weighted at a lower end and flanged at an upper end thereof, secures a buoy in place but pulls up through the buoy for easy retrieval by boat crews. Embedding an anchor is by hydraulic water jet drilling. From a thimble in the anchor to a thimble in the upright at the buoy, no intervening metal components are needed in the load path. Markings are durably and protectively embedded in recesses below the buoy's outer surface.

20 Claims, 22 Drawing Sheets

(51) Int. Cl.
*B63B 22/02* (2006.01)
*E21B 7/18* (2006.01)
*B63B 22/04* (2006.01)

(52) U.S. Cl.
CPC ..... *B63B 2021/267* (2013.01); *E02B 2201/00* (2013.01)

(58) Field of Classification Search
CPC ..... B63B 2021/26; B63B 2021/267; B63B 2022/02
USPC ..... 441/3, 6, 21, 22, 23, 27, 32
See application file for complete search history.

(56) References Cited

U.S. PATENT DOCUMENTS

| | | | | |
|---|---|---|---|---|
| 631,168 | A | 8/1899 | Langston | |
| 2,967,398 | A | 1/1961 | Smith | |
| 3,011,178 | A | 12/1961 | Stone | |
| 3,130,703 | A * | 4/1964 | Thompson | B63B 22/08 114/294 |
| 3,444,693 | A | 5/1969 | Busey | |
| 3,714,923 | A | 2/1973 | Mariani | |
| 3,863,455 | A | 2/1975 | Fuller | |
| 3,952,521 | A | 4/1976 | Potter | |
| 3,991,576 | A | 11/1976 | Tazaki et al. | |
| 4,098,086 | A | 7/1978 | Desty et al. | |
| 4,200,190 | A | 4/1980 | Tyson | |
| 4,517,913 | A * | 5/1985 | Albertini | B63B 21/20 114/230.2 |
| 4,574,539 | A | 3/1986 | Deike | |
| 4,576,521 | A | 3/1986 | Conrad | |
| 4,688,360 | A | 8/1987 | Luong | |
| 4,727,694 | A | 3/1988 | Rockenfeller | |
| 4,993,870 | A | 2/1991 | Bridgewater | |
| 5,097,788 | A * | 3/1992 | Castel | B63B 21/50 114/293 |
| 5,123,779 | A | 6/1992 | Miller | |
| 5,173,006 | A | 12/1992 | Lowe | |
| 5,322,386 | A | 6/1994 | Trangsrud | |
| 5,625,984 | A | 5/1997 | Chapman | |
| 6,986,624 | B1 | 1/2006 | Tabler | |
| 7,390,141 | B2 | 6/2008 | Rytand | |
| 2009/0020065 | A1 | 1/2009 | Paz | |
| 2009/0107387 | A1 | 4/2009 | Horton, III | |
| 2011/0002739 | A1 | 1/2011 | Howland | |
| 2013/0192652 | A1 | 8/2013 | Simonson | |
| 2017/0190387 | A1 * | 7/2017 | Betcher | B63B 21/26 |

FOREIGN PATENT DOCUMENTS

| | | | |
|---|---|---|---|
| GB | 1149470 | A | 4/1969 |
| JP | 57015094 | A | 1/1982 |
| WO | WO 9407741 | A1 | 4/1994 |

OTHER PUBLICATIONS

ABC Diving, Manta Ray Anchor, http://www.abcdiving.com/anchorsyst/mantarayUk.html#anchorIntroduction, webpage, Aug. 7, 2014.

* cited by examiner

CORROSION-AND-CHAFING-RESISTANT, BUOY SYSTEM AND METHOD

RELATED APPLICATIONS

This patent application is a divisional of U.S. patent application Ser. No. 14/267,612, filed May 1, 2014, now abandoned; which is hereby incorporated herein by reference in its entirety.

BACKGROUND

Field of the Invention

This invention relates to marine systems and, more particularly, to novel systems and methods for buoys and moorings to minimize corrosion, chafing, and their combined damage to marine equipment.

Background Art

Water, whether the salty substance common to the oceans of the world, and their associated tidal rivers and ponds, or fresh water, has a corrosive effect on metals. Moreover, metal apparatus, such as chains, clevis links, cables, thimbles (hondos), loops, rebar, anchors, brackets, and the like have often been used in linkages in tethers between a vessel, such as a ship, boat, barge, or the like and an anchor under water. Likewise, pipelines, buoys for both marking of shorelines, segregated regions, mooring locations, navigation messages, or the like must be moored on the bottom of lakes, rivers, oceans, bays, and so forth.

It is well established that water environments attack metals by several mechanisms including plant life that grows thereon, animal life that attaches thereto, oxidation (chemical corrosion, crevice corrosion, rust, etc.), and the like. Anodic protection, such as zinc plating lasts for a time, and eventually expires. Cathodic coatings such as paint, rubber dipping, and so forth are subject to damage, pin hole penetrations, and the like which, may ravage underlying metallic components once the cathodic coating is breached.

Meanwhile, wind moves water. Therefore, waves move floating objects. Tides and stream flows move items that are under water. Thus, with the passage of time, motion moves submerged metal components about, causing corrosion to increase by chafing off outer layers, thereby exposing lower layers of the base metal and increasing the speed of corrosion.

Steel and iron have been used for millennia. Owners spend substantial resources including time, money, materials, and so forth protecting, servicing, inspecting, and replacing metal components. The effort imposed by bodies of water on owners of metal submerged therein is enormous.

It would be an advance in the art to provide an improved mooring system for mooring vessels (ships, boats, barges, any other watercraft) and underwater structures such as pipelines, piers, other structures, and so forth in a manner to minimize maintenance, repair efforts, and other resources (such as time) for anchoring and keeping such systems. It would be an advance in the art to provide securement systems that are resistant to corrosion, chafing, and so forth.

It would be a further advance in the art to protect intermediate floats, such as mid-line floats, against the tangling that seems to be so pervasive and inherent in tethers or lines that secure moored objects to their anchors on a floor of a water body.

It would be a further advance in the art to provide a buoy mounting system that is serviceable, maintains proper service orientation of a buoy, and resists the effects of corrosion, chafing, and the like. It would be a further advance in the art to provide an improved buoy that can be installed to interface with a system of anchors, lines, mid-line floats, fastening systems, orientation maintenance systems, and the like, thus rendering a buoy easily installed, easily serviced, easily accessed, and easily operated as a mooring device.

BRIEF SUMMARY OF THE INVENTION

In view of the foregoing, in accordance with the invention as embodied and broadly described herein, a method and apparatus are disclosed in one embodiment of the present invention as including an anchor system, a system of thimbles at both ends of a line or restraint that performs the attachment of a vessel to an anchor, a grip associated with a mid-line float and acting as a stopper therefor, an upright system for maintaining a tethered buoy in a properly uprightly oriented attitude, a buoy to serve as a message, marker, warning, or mooring buoy, and a connection system. The connection system includes devices and methods connecting an anchor to a line, the line to a mid-line float, the line to an upright system, and the line and upright system to the buoy.

In certain embodiments, an anchor may be an embedded anchor implanted several feet under the surface of the substrate or floor. This may be referred to herein as the sea floor, notwithstanding the body of water may be a fresh water body and may be a lake, pond, river, or the like. The entire structure may be made of materials that resist corrosion and are formed to minimize the effects of chafing. For example, in one embodiment, a high density polyethylene (HDPE) may be used for its high ratio of strength to density while remaining impervious to corrosion.

In certain embodiments, an anchor system may include a box or crossbar that first penetrates longitudly into a substrate or sea floor a certain distance, after which it is turned or oriented crossways to the bore constituting its insertion direction in order to penetrate into the adjacent region of the substrate material, and thus provide anchor strength.

The crossbar or box may have a rocking horse structure that fits inside a longitudinal cavity in the box structure of the crossbar. This rocking horse will typically have a thimble, between shear plates that extend to form orientation plates fitting beside the thimble, registered into an opening in one top face of the box structure. Between the shear plates is secured, fitted, formed, or otherwise located a thimble that operates to control the radius and diameter of bending of a loop of line. The line may be woven rope that will form the tether between the anchor and an anchored object such as a vessel.

The crossbar or box may be open ended, and may be formed to be an irregular trapezoid. For example, a cut or angle at one end may provide a comparatively sharper edge that will tend to catch on surrounding material, once inserted into a substrate, and thereby obligate the cross bar to change its orientation, dig crossways into the local substrate, and thus turn crossways to provide anchoring force.

In one embodiment, the crossbar or box structure may have a mount at one end, operating as a comparatively thick plate closing or partially closing off the cross-sectional area of the internal opening through the box. The mount may be penetrated with an aperture that is threaded to receive a pipe. Insertion of the crossbar box into the sea floor may thus be done by connecting a pipe into the threaded mount and flowing a liquid therethrough while applying a downward force in an axial or longitudinal direction of the box.

By applying high pressure liquid, such as local water (e.g., sea water, lake water, river water, or the like) through the pipe, the mount end of the crossbar or box becomes a hydraulic jet drill. The comparatively high pressure of the water tends to erode the substrate material ahead of the mount and crossbar, thus drilling into the sea floor. It is urged on by the force applied axially or longitudinally to the pipe.

Upon achieving an appropriate depth, the pipe may be removed after the source of high pressure water has been removed or stopped. The pipe, typically made of steel, may be unthreaded, and the formerly trailing line, previously looped around the thimble and secured to the crossbar, may now be engaged. That is, during the drilling process, the rocking horse with its thimble is already attached to the box or crossbar in order to follow along (beside) the box, as the water jet penetrates down through the interior of the box cross-section. With the trapezoidal shape (from a side elevation view thereof) at the trailing end of the box structure of the crossbar, a sharp edge at the very end will immediately tend to rock against the wall of the bore that has been drilled. The barbed or comparatively sharper blade or edge of the box with its trapezoidal cut will thus engage and penetrate into the side wall of the bore.

Upon application of additional force, the leading penetration end or mount end of the crossbar box will also pull into the substrate, thus further driving the sharpened edge into the substrate. The effect of this is engagement of the crossbar across the direction of the bore, thus thoroughly and immediately engaging the substrate. It has been found that subsequent settling of materials will quickly (e.g., within a few weeks) begin to drift down into the bore, thus further consolidating the crossbar in the bore.

The thimble, mounted between or formed between the shear plates (e.g., typically formed as triangular cleats), secures in an opening in what is now the top side or top face of the box structure of the crossbar. This structure comprises the rocking horse that was inserted inside the sharpened end of the box structure before insertion (drilling) into the substrate.

This insertion or assembly is executed quite straightforwardly by sliding a re-woven loop of braided polymeric rope into the central, top side opening of the crossbar that will eventually register the rocking horse. Upon drawing the loop fully outside the sharpened end of the box structure, an operator may fit one side of the rocking horse with its shear plates (e.g., side cleats) into the loop, thereby positioning the thimble on the inside radius of the loop of line. The entire rocking horse and rope loop system may then be moved back into the open cross-section of the crossbar.

The rocking horse eventually moved laterally outward to be registered in a side wall, which will become the upper face once anchored. In that upper face are fitted the side plates or a shoulder of the cleats, thus registering in every direction the rocking horse. The loop of the line or rope is thus free to pivot about the contained thimble in the rocking horse, and is provided with relief in the top face of the box structure in order to proceed away therefrom.

A grip or worm grip operates as a mid-line float stopper. This may likewise be constructed of a polymeric material, such as HDPE. In fact, in certain embodiments, the rocking horse, the box structure of the crossbar, and so forth are all formed of polymeric materials that are impervious to corrosion.

The worm grip or stopper for the mid-line float may rely on any type of mid-line float available in the art. These are typically egg-shaped but may take on other shapes. They may be penetrated by the line or may be attached beside the line. In one presently contemplated embodiment, the line at a free end, above the lower loop connected to the anchor system, may pass through a tubular, center penetration of a line float. Thereabove, the line may be threaded through a tortuous path in the worm grip that will subject the line to substantially increased friction, thus precluding movement of the worm grip.

Thus, the loss of strength common to knotting a line is avoided, even eliminated. The thimble at the anchor end, and the stop grip, or worm grip at the mid-line float both are calculated to not compromise the strength of the rope beyond its specification for working strength in use. Various embodiments of the float may include a version that includes penetration which may penetrated by loops of the line or rope which may then be captured by a bar or rod passed therethrough, such as by a U bolt or shaft that provides detents against withdrawal. Thus, whether threaded onto a new line upon installation, or attached by looping an extant line therethrough, the worm grip may increase friction and provide resistance to movement of the grip in response to the upward flotation or buoyant force exerted by the mid-line float.

In another embodiment, a tube may be provided with a slot near the top thereof and near the bottom thereof, typically extending from about 90 to about 360 degrees. Typically, a target of about 180 degrees has been found sufficient. In such an embodiment, the line may be installed on such a grip after the float is already in place and after the line has been in service. In this embodiment, the line enters the tube and is captured by one slot, wraps around the tube for some selected number of turns suitable to preclude slipping, and then exits out through the opposite end of the grip, by passing inward through the slot to exit parallel to and at the top end of the tube.

The upright system may include a shaft, which is actually a tube receiving the line or rope. The line may be completely continuous or may be connected above or below the line float. For example, a re-braided rope loop may be formed at each end of the line. Accordingly, such lines may be prepared to have standard lengths. A pair of lengths of rope or line may be selected, one to be secured at the anchor end and one to be secured at the buoy end of a mooring system in accordance with the invention. The two free ends may then be secured by a suitable mechanism that provides stress relief (e.g., does not weaken the rope below its appropriate rated value of sustainable force), such as a thimble system, a bowline or other accepted mechanism.

In certain embodiments, the upright may extend several feet, such as, from about 4 to about 12 feet long. It has been found suitable for most buoys to extend the upright a distance of about 6 feet and to weight the lower end thereof with a suitable weighting system. For example, a collar may be formed in one or more parts and secured to the lower end of the upright. In another embodiment, the collar is slid over the lower end of the upright and a flange, pin, or other keeper is placed to keep it secured to the upright shaft.

In other embodiments, a pin may secure together a collar formed in one or more pieces that simply clamp onto a lower end of the upright shaft or sit on a flange formed at the bottom end thereof. In yet another embodiment, a shaft, such as a pin, bolt, rivet, screws, or the like may pass through a collar having one or more pieces fitted to surround the lower end of the shaft. Thereby, the weight may be maintained at its proper axial position along the shaft.

In other embodiments, where the collar may be positioned after the lines are all in place, such that one may not be able to pass a line therethrough, the collar may be formed in two or more parts. For example, it may be held together by the pin which also holds the collar together and secures it at its axial position along the shaft.

The lower extremity of the shaft may be threaded, flanged, or simply free with no treatment other than a set of apertures passing through opposite walls to hold a weight, while passing the line through the shaft toward the buoy.

The upper end or the topside end of the shaft may be provided with a flange in order to prevent sinking down through the buoy. Typically, the shaft will pass up through the buoy, or be passed down through a bore in the buoy, in order to stabilize the buoy and tether it. Above the flange, which is rotatable within a recess at the top of the buoy, a chamber containing a thimble covers a loop in the line at the upper extremity of the line (e.g., rope).

The chamber may have one or more faces that may be opened in order to position the rope loop around a thimble. The thimble may be built into the chamber, built into a cap or cover on one side of the chamber, or may be inserted into an empty chamber and then enclosed. The chamber may be completely closed off on both of the flat sides thereof such that a bail may be secured to the thimble.

For example, a shaft, such as a bolt, passing through the bail, through the side walls of the chamber, through the thimble contained within the chamber, and thus through the rope loop, may be secured by a nut on an opposite side of the bail. The bail may be embodied as a clevis holding, for example, a mooring ring. A mooring ring held by the clevis, bracket, or bail may be regularly accessed by a boat owner to moor a vessel to the buoy.

In certain embodiments, the upper loop, by way of the bail, may be lifted up through the buoy to the extent of the shaft. With the weight operating as a restraint, a buoy may actually be lifted out of the water supported by the weight collar fixed at the end of the shaft.

In certain embodiments, a pole, such as a "painter pole" may be secured in an auxiliary bore in a buoy, formed to extend in an axial direction into or through the buoy and parallel to the central bore thereof. In this way, a vessel having a deck some distance about the buoy presents no problem to capture the buoy. For example, a hook, loop, or the like at the top of a painter pole secured into the auxiliary bore may be readily captured. Thereby, the buoy may be lifted, and access to the mooring ring may be had readily by the operators of a vessel seeking to use the mooring buoy.

In some embodiments, a lock may be prepared and secured to cover the mooring ring, thus rendering it unavailable to improper use or unauthorized users. It is not entirely uncommon for unauthorized persons to temporarily secure to a mooring buoy without permission, thus inconveniencing the correct owner when approaching the buoy for use.

The buoy may be provided with, or originally formed as, an outer shell. The shell walls may be manufactured by any suitable method, such as by blow molding or roto-molding. In roto-molding, one benefit to a design of a buoy in accordance with the invention is that the central shaft may be formed with the outer shell to be completely sealed and impervious. However, it has been found suitable to back fill the buoy with a closed cell polymeric foam.

The auxiliary bores may be formed by any suitable method, such as forming during roto-molding, or being drilled thereafter. Seats in the top or topside ends of each of the auxiliary bores may be formed during manufacture of the main outer housing or shell, or may be formed thereafter. In one presently contemplated embodiment, the seats may be formed to provide a shoulder against which a flange may rest or a fastener may be set.

Typically, the recess on the central bore is formed as part of the outer wall, homogeneous, contiguous, integral, and continuous therewith. Meanwhile, recesses over a pair of symmetrically opposite and diametrically opposed auxiliary bores may be formed. Thereafter, a drill may be used to form each of the auxiliary bores. In yet another example, the seats or recesses for the auxiliary bores may be used as parts into which to inject the foam, thus providing access therefore without additional penetrations.

Thereafter, the bores may be drilled, or may be fitted with sleeves or liners before or after formation. For example, a liner may be placed through to form each bore, and the expanded polymeric foam may surround all three bores or the walls thereof within the buoy during a filling or foaming process.

In one contemplated embodiment, a process for installing the system in accordance with the invention may be best adapted to substrates (sea bed, lake bottom, etc.) in locations where stones are not excessively large. For example, gravel, comparatively small cobble, and the like may be jet drilled by hydraulic force. However, solid rock, large boulders, larger cobble (larger than a fist), and the like are not typically penetrated by hydraulic pressure. Accordingly, a system and method in accordance with the invention may be best adapted to sea beds or lake bottoms that may be drilled readily by a hydraulic jet.

Meanwhile, in one currently contemplated embodiment, a drill bore in a sea bed may be formed at from about zero degrees to about 60 degrees with respect vertical line perpendicular to the sea bed. However, it has been found suitable to provide a drilling process at from about 10 to about 30 degrees, and preferably targeted at about 20 degrees off the vertical axis or perpendicular axis extending to the sea bed. Having a slight angle assists in exaggerating the eccentricity of the forces on the anchor box structure. Moreover, it has been found that the process of "setting" by "pulling in" the anchor or pulling the anchor system into the sidewalls of the drill bore in the sea substrate is assisted by a tendency of the line to cut back on one side of the bore in seeking a direct line between the anchor box and the winch applying upward force. Thus, the additional overburden directly above the anchor assures that the anchor cannot be drawn out the same direction it entered the sea bed.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
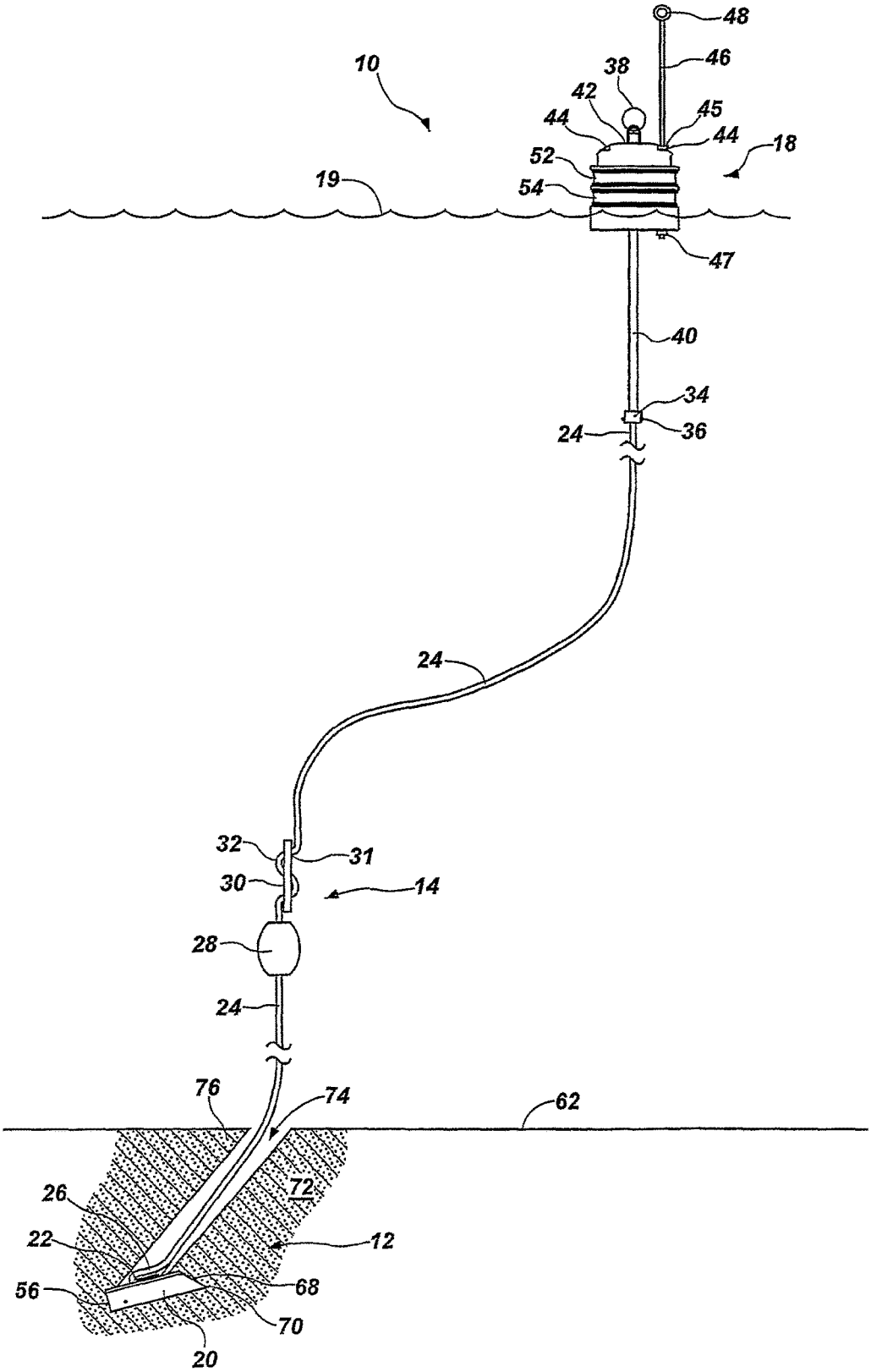
FIG. 1 is a side elevation view of one embodiment of a system and apparatus in accordance with a method.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Figure 2:
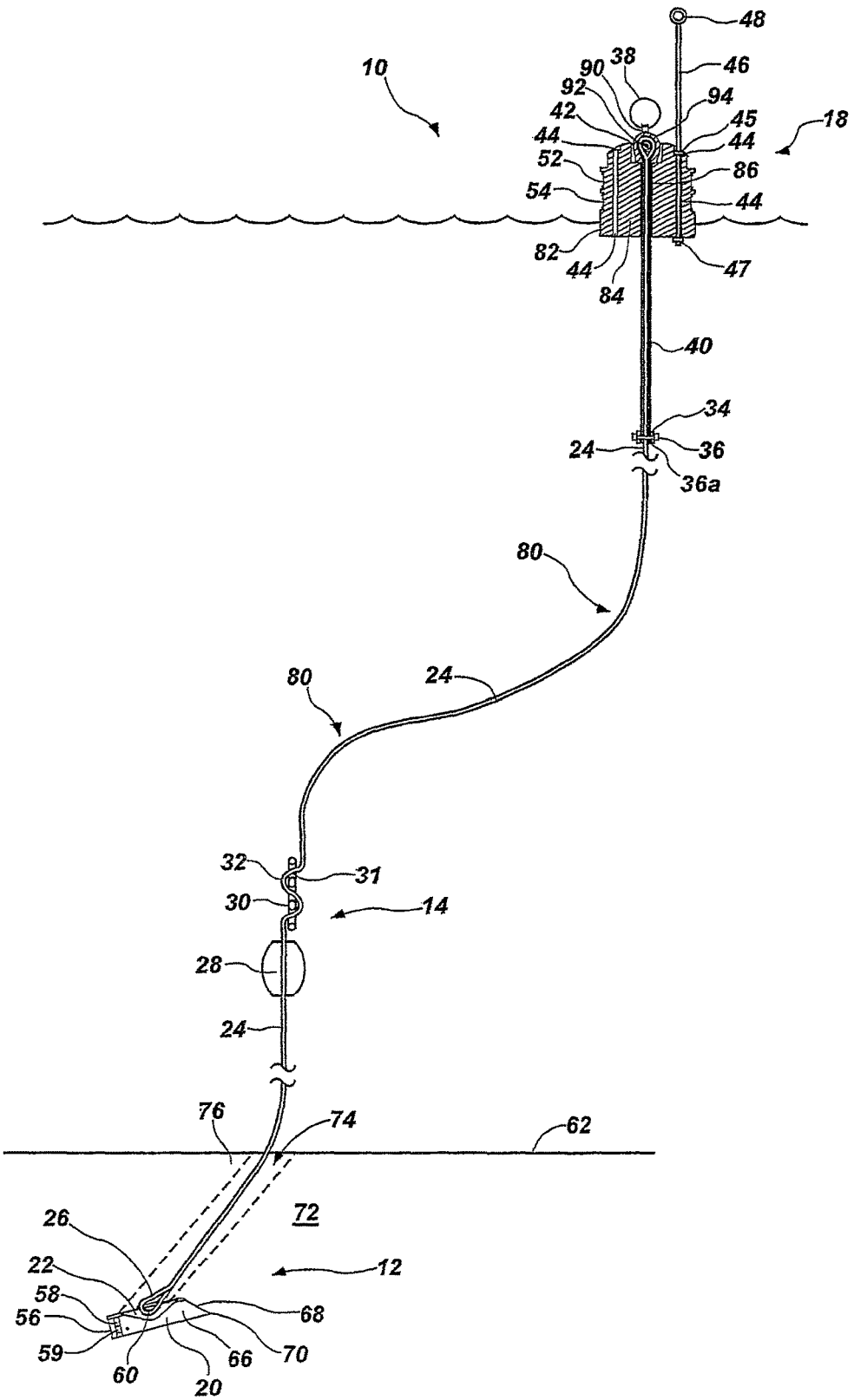
FIG. 2 is a cross-sectional view of the system of FIG. 1.

Referring to FIGS. 1 through 2, while referring generally to FIGS. 1 through 21, a system 10 in accordance with the invention may include an anchor subsystem 12. The anchor subsystem 12 may be thought of as an embedded anchor system 12. Above the anchor subsystem 12 arises a line 24, or rode 24, which may be formed of a polymeric, non-metallic, braided rope. Such a line 24 has been found preferable to laid rope, chain, metal cables, steel rope, and so forth. The line 24 arises through a line float subsystem 14 that maintains tension in order to resist damage to underwater plants in the ecosystem of the sea bed.

Ultimately, the line 24 passes through an upright subsystem 16 that includes a shaft 40 or tube 40 through which the rode 24 will pass in order to be secured to the top thereof. The upright subsystem 16 is weighted at the bottom end thereof, which may be from about 4 to about 12 feet below the surface, and is preferably at from about 5 to about 7 feet below the surface. At a distance of 6 feet, an upright subsystem 16 has been found to be suitably counterweighted by a weight of about 4 to 20 pounds with a target weight of 10 pounds in order to keep the upright system 16 in a comparatively upright orientation in the water.

A buoy subsystem 18 is secured to ride on the surface 19 of the water, secured by the upright subsystem 16. The buoy subsystem 18 includes suitable materials to float, provided with an opening 86 through which the upright subsystem 16 will penetrate. The upright subsystem 16 may be lifted up out of the water through the buoy subsystem 18 for access, lifting, and the like. Meanwhile, in operation, the upright subsystem 16 suspends in the water from the buoy subsystem 18, which provides flotation, marking, mooring, or the like.

In general, a head 20 or crossbar 20 in the anchor subsystem 12 provides securement in a sea bed 72 by embedment or embedding within the sea floor 62. In the illustrated embodiment, the head 20 or crossbar 20 is a box 20 provided with a cross-sectional area that provides engineered strength and stiffness. The crossbar 20 may be configured in the form of a hollow I-beam configuration.

A rocker 22 or rocking horse 22 may be fitted into or otherwise associated with the crossbar 20 in order to secure a line 24 that terminates in a loop 26 at the anchor subsystem 12. In the illustrated embodiment, the crossbar 20, with the rocker 22 removed may receive a line 24 through an aperture 67 near the center of the crossbar 20, and extending out through one end of the crossbar 20. Thereat, the rocker 22 (or at least one plate 64) may be inserted through the loop 26 and the line 24. The rocker 22 may then slide axially back through the hollow interior portion of the crossbar 20 to a location at which the loop 26 and line 24 may exit on the aperture 67. Registration of the rocker 22 in the aperture 67 is fixed at a suitable location in the top plate 21 of the crossbar 20.

A float 28 may be of any particular type, such as a line float 28, underwater, mid-line float 28, or the like. Typically, floats 28 are of various types, but should be substantially constant volume, and are often formed of a very strong, stiff, thick-walled, durable plastic that is completely hollow and largely impervious to breakage, leakage, or the like. Accordingly, the float 28 may be sized to provide a sufficient buoyancy force to maintain a substantially constant tension in the line 24. In order to maintain the float 28 in position, a stop 30 (e.g., worm grip 30) may secure the line 24 to the float 28. As a practical matter, the float 28 will float up along the line 24, until arriving at the stop 30. Thus, the stop 30 provides capture of the float 28.

In the illustrated embodiment, the line 24 passes through the stop 30 by means of several convolutions 32 or turns 32. Each of the convolutions 32 is engineered to minimize the stress in the line 24, and may be radiused at a specific turn radius to prevent excessive stress in the line 24.

For example, a line 24, when knotted, places the bundle of fibers constituting the line 24 into compression at the innermost radius of any turn, and in tension at the outermost turn. Accordingly, great differentials of stress exist across the cross-section of the line 24. A line 24 may lose substantial pull strength (tensile strength) because of the pre-loading effect of a knot placed in the line 24. In the system 10 in accordance with the invention, no overly stressing knots are provided in the line 24. Line manufactures do not require de-rating a line for a bowline more than 25 to 30 percent. Thus, the convolutions 32 are also configured at a size and turn radius that each presents no significant degradation in the rated load (force) value carried by or available for the line 24 as specified.

As the line 24 progresses upward, it passes a weight 34 (maintained by a keeper 36), which maintains the upright subsystem 16 properly oriented. The upper end of the upright subsystem 16 may include a ring 38 or tie member 38 for the purpose of mooring a craft (boat, yacht, barge, or other craft) thereto. Meanwhile, a column 40 acts as an upright 40 and may be constituted by a shaft. More properly, the shaft 40 may be a tube 40 operating as a column 40 enclosing the line 24 while extending the distance at which the weight 34 rests below the ring 38 connected the column 40.

The column 40 is maintained in place by a flange 89 fitting in a recess 42 at the top of the buoy subsystem 18. The recess 42 provides a seat 87 wherein the flange 89 acting as a bearing 89 may rest.

Bores 44 (auxiliary bores 44) may be provided outboard from the column 40 about the buoy subsystem 18. These bores 44 may be configured as tubes 44, openings 44, or accesses 44 in order to receive, for example, a pole 46, such as a painter pole 46. Such a pole 46 may be provided with a support 45 near the top of the buoy subsystem 18, and some securement 47 at the lower extremity thereof. Thus, the pole 46 may be used to carry a flag or marker, banner, or the like.

Typically, the pole 46 may be provided with a capture 48 at a top end thereof. The capture 48 may be configured as a loop 48, hook 48, both 48, or the like. Thus, a watercraft having a deck much higher than the ring 38 at the top of the buoy subsystem 18 may more easily access the ring 38 by capturing the "capture" element 48 by a rope, a grip, a boatman, or the like. The capture 48 may be used to lift the buoy subsystem 18, or may be used otherwise to access the ring 38.

For example, in one embodiment, the painter pole 46 may be provided with a capture 48, but lack a securement 47 at the bottom thereof. A support 45 may maintain the pole 46 in the bore 44, against gravity. However, with no securement 47 therebelow, a boatman may remove the pole 46 from the access bore 44. One will thus have available a hook 48 or loop 48 as a capture 48 in order to withdraw the pole 46 from the access bore 44. One may then use the same capture 48 or hook 48 at the end of the pole 46 to reach down and snare the ring 38, then drawing the ring 38 up towards the deck for attaching a mooring line thereto.

Alternatively, a capture 48 may simply be used with a securement on the bottom of the pole 46, to lift the entire buoy subsystem 18, and with it the upright subsystem 16. Thereby, the ring 38 may be brought upward to be available for access.

The buoy 50 itself, or the body 50 of the buoy subsystem 18 may be provided with a marker 52 at a suitable location for warnings, other labeling, instructions, and so forth. The marker 52 is typically used for messaging through textual content.

In contrast, a marker 54 may typically be a colored marker 54, as required by maritime statutes in order to identify the type of buoy 50 in the system 10. For example, channel markers, warning markers, boundary markers, property markers, hazard markers, and the like may be served by a system 10 in accordance with the invention. Also, a system 10 makes a highly serviceable mooring buoy 50.

Referring to FIG. 2, while continuing to refer generally to FIGS. 1 through 21, the anchor subsystem 12 may have a crossbar 20 or box 20 identified by a lead end 56 and a trailing end 57. In the illustrated embodiment, near the lead end 56 is a mount 58 or mounting plate 58 provided with a threaded opening 59. The threaded opening 59 provides a securement 59 to receive a steel pipe 55. The steel pipe 55 operates to carry water under suitably engineered pressure to the threaded opening 59 in the mount 58.

By passing the steel pipe 55 through the length of the anchor subsystem 12, the head 20 becomes a drill head 20 for hydraulic jet drilling. A jet of water exiting the steel pipe 55 through the threaded opening 59 impacts and erodes the surrounding surface 62 of the sea bed 72, opening up a bore region 74 through which the crossbar 20 will pass as a drill head 20 into the sea bed material 72. The crossbar 20 is formed as a box 20 that also constitutes the head 20 or principal portion 20 of the anchor subsystem 12.

Meanwhile, the line 24 is secured, in advance, by passing the line 24, with the loop 26 first through the aperture 67 into the empty crossbar 20, which has a hollow channel 61. The loop 26 exits at or near the trailing end 57. The loop 26 is then secured around a thimble 60 that forms part of the rocker 22.

The rocker 22 may be fabricated from a single piece of material. In other embodiments, the rocker 22 may be an assembly constituted by a thimble 60 flanked by plates 64 (e.g., shear plates 64) that are each largely a smoothed triangular shape in area, having registration shoulders 66 formed therein to fit within a mating portion 67 or aperture 67 formed in the top surface of the crossbar 20.

The loop 26 passing out through the channel 61 may be worked over one of the plates 64, which operate as shear plates 64, in order to be wrapped around or conform around the thimble 60. The loop 26 may be formed as a re-woven or re-braided loop 26 formed in a braided line 24. A suitable polymeric material that is relatively resistant to or impervious to attack by the chemical composition, microbes, plants, animals, and other sea life in a lake or ocean may serve as material for the line 24 and loop 26.

With the loop 26 threaded around the thimble 60, between the plates 64, the line 24 may be drawn back up toward the aperture 67, thus drawing the rocker 22 back through the channel 61. Once the loop 26 is secured around the thimble 60 the rocker slides back inside, along the crossbar 20 to the aperture 67. The shear plates 64 register in the aperture 67 to position and maintain the thimble 60 in place. The registration shoulders 66 on the shear plates 64 can be moved up into the aperture 67, registering the thimble 60, shear plates 64, and the entire rocker 22, in general, in the aperture 67 in the upper surface of the crossbar 20. The rocker may be fastened in with a bolt of some kind to index it during the setting process. The bolt is only necessary during installation. It can corrode away after the anchor is set, or it can be plastic. The loop 26, will, typically, never again have the proper alignment of forces required in order to remove it from the thimble 60 without human intervention.

The crossbar 20 is formed in a trapezoidal shape to include a guide surface 68 or guide slope 68 at the trailing end 57. Here, the trailing end 57 is so identified with respect with the lead end 56. The lead end 56 and trailing end 57 apply only to the process of drilling or injecting the anchor subsystem 12 into a substrate 72 or sea bed 72. In operation, after so drilling, the crossbar 20 engages a cutting edge 70 or trailing edge 70 of the trailing end 57 of the crossbar 20.

In other words, upon removal of the steel pipe 55, from the threaded opening 59 after drilling, the crossbar 20 sits within the bore region 74 drilled into the sea bed 72 by the water jet from the steel pipe 55. The edge 70 is comparatively sharp, and the positioning of the aperture 67, and thus the rocker 22 may be slightly eccentric, or not centered with respect to the overall length or weight of the crossbar 20. Thus, upon removal of the steel pipe 55, following drilling of the bore region 74 in the sea bed 72, the edge 70 will typically move toward the boundary of the bore 74 or bore region 74, thus tending to engage or cut into the sea bed 72.

After the steel pipe 55 is removed, then drawing on the line 24, tensions the loop 26, which transfers force to the thimble 60, which, in turn, transfers force to the shear plates 64, which then apply force to the crossbar 20, in the direction of the line 24. This direction of the line 24 drawing on the rocker 22 and hence the top plate 21 and crossbar 20, tends to pull the crossbar 20 toward its top plate 21 rather than axially or collinearly along the length of the crossbar 20.

Meanwhile, the edge 70 cut into the wall of the bore 40. By the force on the line 24, it is driven into the sea bed 72 adjacent the bore 74. The effect is to cut with the edge 70 into the sea bed 72, while the lead end 56 engages the opposite side of the bore 74. Thus, the two ends 56, 57 each force the other into the sea bed 72 in a direction perpendicular to the length of the bore 74. Accordingly, part of the sea bed material 72 is dug up and begins to fill in the bore 74 above the crossbar 20. The result is further anchoring of the crossbar 20 in the undisturbed sea bed 72, that part that did not participate, or was not washed out with the material removed in drilling the bore 74. The result is a very strong anchoring force supportable on the line 24. The anchor subsystem 12 has been "set."

It has been found that the crossbar 20 is capable immediately of sustaining forces approaching the limit of the dynamometer so applied. However, over time, materials will settle into the bore 74, completely and effectively filling the bore 74, and settling in. Thereby, the bore 74 is no longer a bore 74, but a bore region 74 filled with materials from the sea bed 72.

For example, in one experiment, a crossbar 20 was drilled into a sea bed 72, with a line 24 secured by a loop 26 around the thimble 60. The limit of the dynamometer attached to measure the load on the line 24 was 4,000 pounds (1,800 kg.). The installed anchor subsystem 12 withstood the force on the line 24 to the limit of that particular dynamometer.

Inasmuch as a working craft will be stationed on the surface 19 of water such as a lake, bay, cove, ocean, or the like, setting the anchor subsystem 12 by applying a force to a line 24 secured around the thimble 60 of the crossbar 20 will result in drawing the boat back toward the anchor. The line 24 in tension during the installation will tend toward a vertical orientation.

In contrast, it has been found best to angle the direction of the bore 74 to be from about 5 to about 45 degrees with respect to the surface 19 of the water. Accordingly, the best angle of the bore 74 has been found to be from about 15 to about 25 degrees, and typically about a 20 degree angle has been found a good target angle to use for drilling a bore 74.

Thus, as the installation or "working watercraft" is drawn to be more directly vertically above the embedded crossbar 20 at the bottom of the bore 74, the line 24 tends to cut into the sea bed 72, in a lateral direction (orthogonal to the vertical direction, orthogonal to the bore direction, or both) thus cutting into the sea bed 72 throughout a cut region 76. This cut region 76 tends to render the force in the line 24 to be more nearly vertical. Thus, this further assures embedding of the crossbar 20 below undisturbed sea bed 72 in the cut region 76.

The drill angle has more to do with setting the anchor, than how it will perform with a boat moored to it. Actually having the angle vertical is the best except to set the anchor in the unconsolidated sediment. Putting it in at a bit of an angle lets the anchor "set" in undisturbed sediment.

After installation, the free end of the line 24 may be freed from the craft installing the system 10. The line 24 may connect to another portion of line 24 that also extends upward therefrom toward an upper loop **26*b*. Herein, a trailing letter following a reference numeral refers to a specific instance. Use of the reference numeral indicates any or all of the items so indicated by the number. A reference numeral followed by a trailing letter refers to a specific instance. Here, the lower loop 26*a* is secured around the thimble 60 in the crossbar 20. The upper loop 26***b* is likewise secured in a similar fashion to the buoy subsystem 18, by way of the upright subsystem 16. Various mechanisms, thimbles 60, loops 24, fasteners, or the like may be used to select and implement the proper length of line 24 extending between the crossbar 20 and the buoy 50.

In certain embodiments, the stop 30 may be placed in the portion of line 24 proceeding, continuous and uninterrupted, from the thimble 60 in the crossbar 20. It may instead be in that portion of the line 24 that extends continuously and uninterrupted from the buoy subsystem 18 and upright subsystem 16. Ultimately, in either configuration, the float 28 will be placed as a mid-line float 28 in or on the line 24.

The float 28 will be secured by the stop 30. This leaves the remainder of the line 24 above the float 28 as a slack portion 80 that may go slack at any time with a shift in wind direction, tide, current, or the like.

For example, the tensioned portion 78 of the line 24 extends from the thimble 60 at the crossbar 20 up to the stop 30 that is holding the float 28 in its vertical position. That is, the stop 30 maintains the float 28 at a particular altitude with respect to the sea bed 72. However, with shifts in wind direction, tide, current, and so forth, any craft secured to the buoy subsystem 18, and particularly to the ring 38 or tie member 38, will drift with the wind, drawing the buoy subsystem 18, with it, and eventually pulling tension in the slack portion 80 of the line 24.

Nevertheless, during such a movement, tension in the slack portion 80 may be reduced, or may be eliminated, resulting in slack, or reduced force. As a practical matter, the designation of the slack portion 80 as such simply refers to the fact that with rising and lowering of tides, the slack portion 80 may be temporarily untensioned. In contrast, the mid-line float 28 and stop 30 maintain tension 78 of the buoyant force of the float 28 on the line 24 in the tensioned portion 78.

Eventually, the line 24 must enter the buoy subsystem 18. It does this, in the illustrated embodiment, by entering the column 40 or shaft 40 of the upright subsystem 16, near the weight 34 at the foot or bottom end thereof. From the foot or bottom end of the column 40, the line 24 passes upward through the column 40 and the buoy 50 of the buoy system 18. The buoy 50 or the buoy body 50 may typically include a wall portion 82 of a comparatively higher density, solid, structural, polymeric material, while the interior fill portion 84 thereof may typically be of a comparatively lower density, closed-cell, foamed polymer (expanded polymer). Typically, an expanded polymeric material is referred to as a foam. The fill 84 may be expanded polyethylene, expanded polystyrene, expanded polyurethane, or other suitable material. However, it has been found best to select a polymeric material for the fill 84 that is of a closed-cell type, resistant to incursion by bacteria, sea plants, sea animals, chemical degradation, and the like. In this way, the fill 84 does not become laden or water logged with moisture, organisms, and so forth.

Meanwhile, the central bore 86 through the buoy 50 may be formed of the same material as the wall 82. In certain embodiments, the buoy 50 may be formed by roto-molding with the exterior surfaces thereof and the central bore 86 as a single continuous and contiguous material. In certain embodiments, the bores 44 may also be formed the same as the central bore 86.

However, it has been found that a more practical manufacturing technique may be to create the central bore 86 as part and parcel of the outer skin or shell of the buoy 50, formed continuously and contiguously with the wall 82. Bores 44 may be added thereafter. The fill 84 may be added through one of the seats 88 of the bores 44. An aperture may be formed in the outer skin of the buoy 50, at the seat 88. Thereafter, after the fill 84 has been introduced and cured, then the bore 44 may be drilled through the fill 84.

The seat 87 associated with the central bore 86, provides a position for the flange 89 or bearing 89. The flange 89 may be integral with the column 40 to be supported by the seat 87 in the recess 42 at the top of the buoy 50.

In the illustrated embodiment, the seat 87 is completely circular, providing a surface 87 or seat 87 on which the flange 89 or bearing 89 of the upright subsystem 16 may rest. Similarly, if the upright subsystem 16 is drawn up through the buoy subsystem 18, then the collar 34, acting also as a weight 34, and its keeper 36 will restrain the column 40 from rising completely out of the buoy 50. The weight 34 and keeper 36 will lift the buoy 50 once they have engaged the bottom surface of the buoy 50. Then, the ring 38 may be lifted up, at the top of the upright subsystem 16, for access. Similarly, the buoy 50 itself may be lifted up by drawing the upright subsystem 16 therethrough and upward.

The ring 38 may be secured to the upright subsystem 16 and thereby to the buoy subsystem 18. The ring 38 is typically secured by extending the circumference of the ring 38 through a bail 90. The bail 90 operates as a bracket 90 secured to the housing 94 of the upright system 16 by means of an axle 92 or bolt 92. Any type of linear fastener 92, such as a pin 92, or the like may be used. In certain embodiments, the axle 92 may be made of a polymeric material. However, metals are suitable, since the axle 92 is not exposed to immersion.

A housing 94 contains an upper loop 26*b* terminating the line 24. By means of the axle 92, the loop 26*b* is retained. The bail 90 secured to the loop 26*b* by the axle 92, bolt 92, fastener 92, pin 92, or the like sustains the full load in the line 24. The load path from the ring 38 through the bail 90, to the axle 92 and an intervening thimble 60, to the loop 26*b*, and line 24 is the entire load path to transfer force from a moored craft tethered through the ring 38 to the line 24.

The entire length of the line 24, whether in multiple or single continuous segments, extends the load path from the axle 92 at the upper loop 26*b* down to the anchor thimble 60 surrounded by the lower loop 26*a*. This entire load path has no intervening metal carrying load or responsible to maintain load between the upper loop 26*b* and the lower loop 26*a*. Thus, corrosion is eliminated and chafing is minimized.

Meanwhile, the bail 90, the axle 92 to which it secures through the upper loop 26*b* as well as the ring 38 may conveniently be made of metal, polymer, reinforced polymer, or the like. For convenience, suitable metals may be used for one or more of the axle 92, bail 90, and ring 38. It has been found that the lack of immersion minimizes corrosion, and the availability of these components for inspection reduces service and maintenance cost, removing the need for them to be made out of non metal parts.

Moreover, the use of metals, such as iron and steel, provides for additional strength, and thus a smaller size for each of these components Likewise, because these objects are largely unexposed to sea water, or other water sources, other than rain, they have been shown in the observations of Applicant to be comparatively unaffected by corrosion, attack by organisms, whether plant or animal in nature, chafing, and the like. Thus, these components may be made of metal of any suitable marine type, including anodically coated, cathodically coated, passivated, and so forth.

Figure 13:
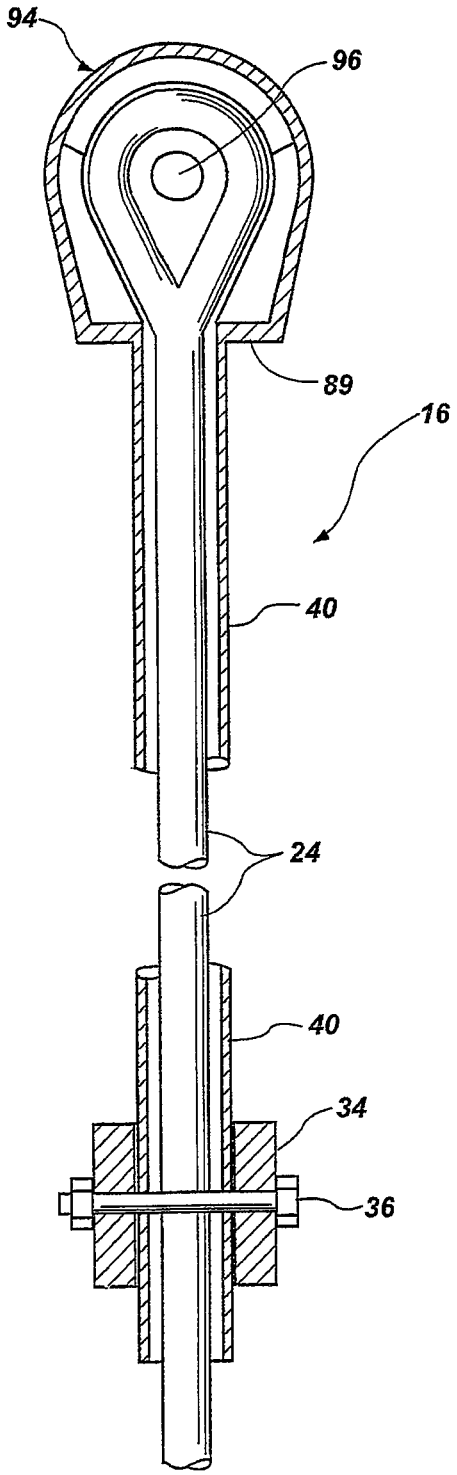
FIG. 13 is a side elevation cutaway view thereof.
Figure 14A:
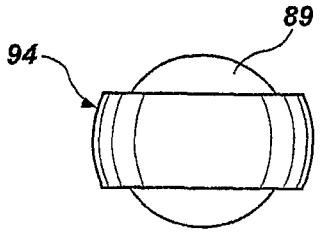
FIG. 14A is a top plan view of the upright system of FIGS. 12 through 13.
Figure 14B:
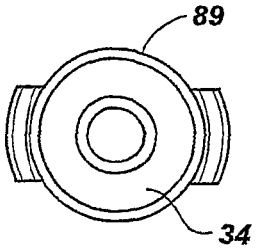
FIG. 14B is a bottom plan view thereof.
Figure 14C:
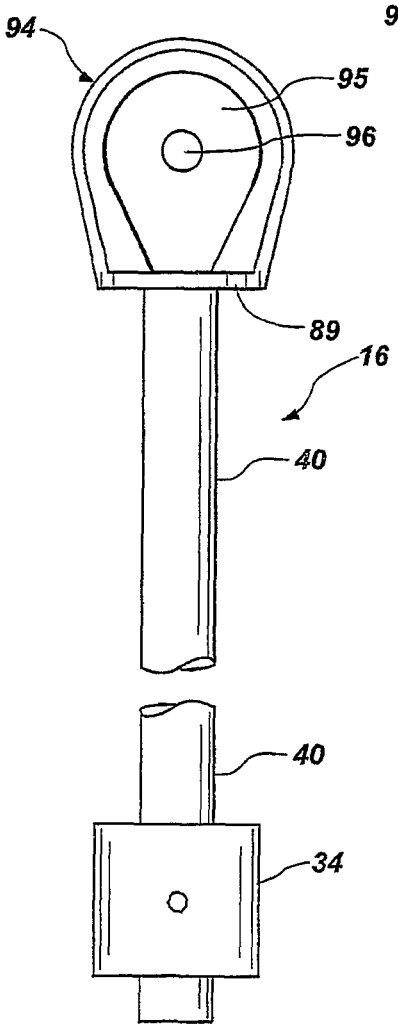
FIG. 14C is a front elevation view thereof.
Figure 14D:
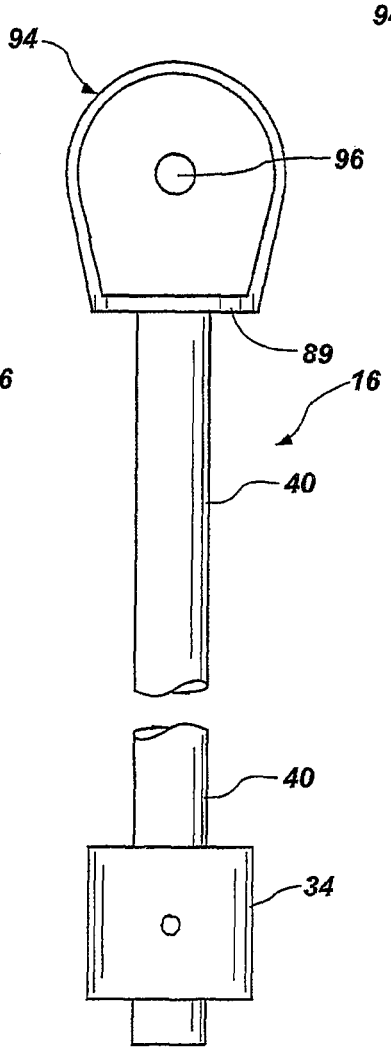
FIG. 14D is a rear elevation view thereof.
Figure 14E:
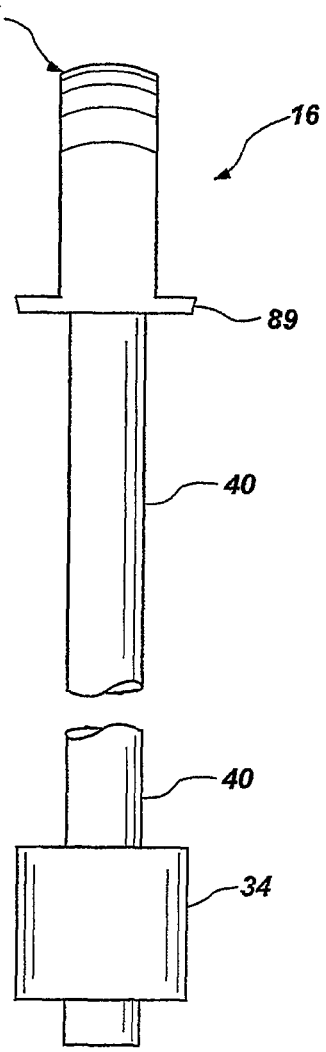
FIG. 14E is a side elevation view thereof, both right and left side elevation views being identical.
Figure 15:
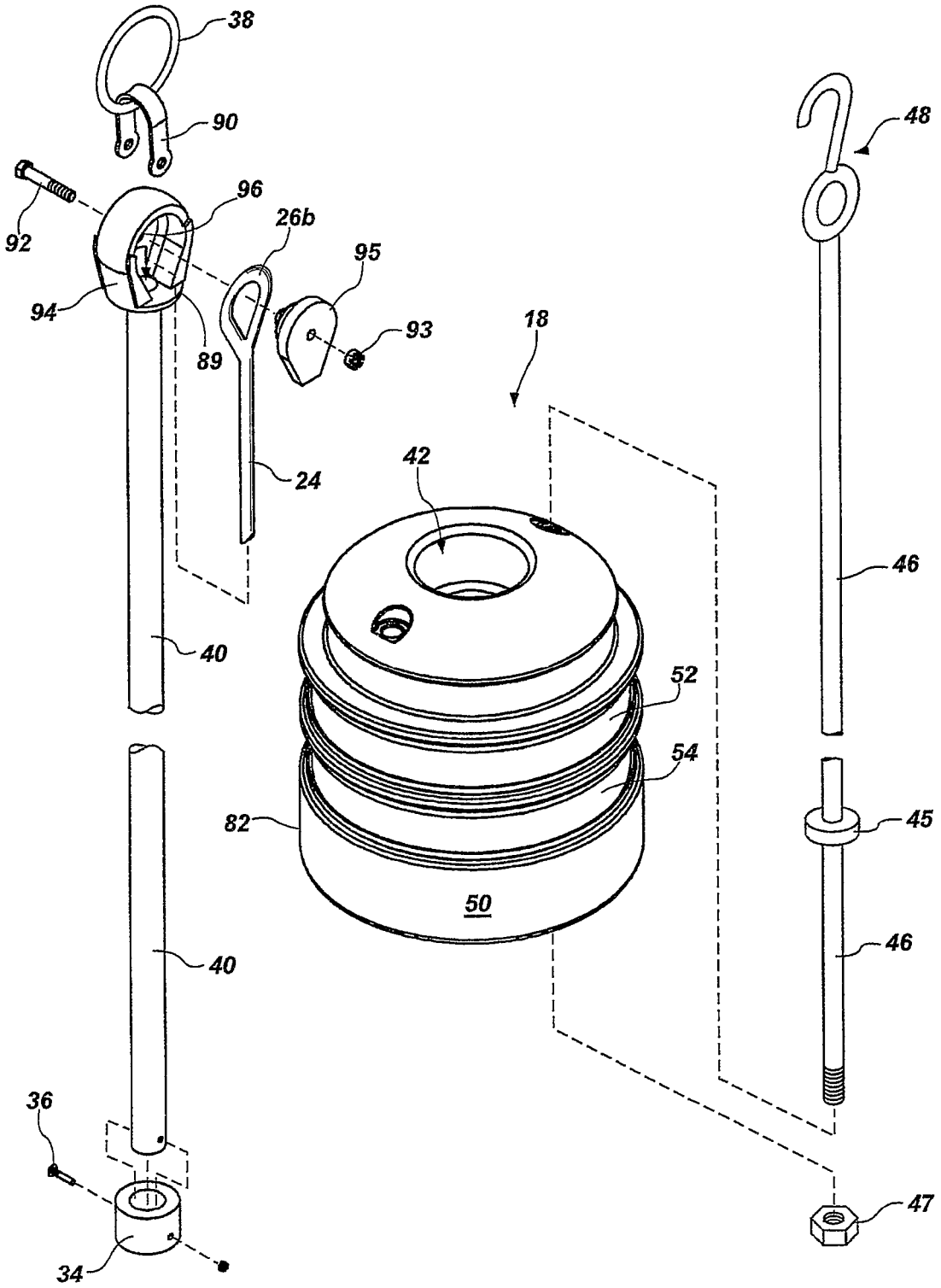
FIG. 15 is a perspective, exploded view of the upright system of FIGS. 12 through 14 along with the buoy system of FIGS. 15 through 19.
Figure 16:
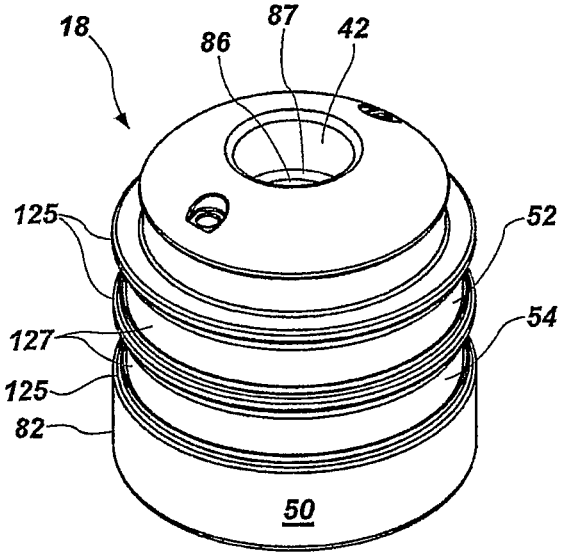
FIG. 16 is a perspective view slightly above and from the front of a buoy subsystem in accordance with the invention.
Figure 17:
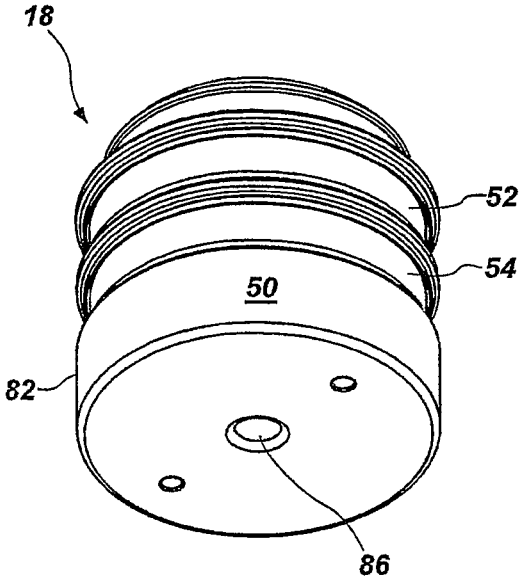
FIG. 17 is a perspective view from a lower vantage point.

The housing 94 includes a thimble 95 (see FIGS. 13 through 15). In the illustrated embodiment, the thimble 95 is integrated as a cap 95 that fits into the housing 94. Alternatively, one may think of the housing 94 as including a cap 95 operating as a thimble 95. In general, one may refer to the thimble 95 as the pulley-like element (e.g., hondo) received within the upper loop 26*b*.

However, in a typical manufacturing process, the cap 95 may be made formed or fabricated as a homogeneous, monolithic piece from a single molded or fabricated block of material, such as a suitable polymer. Thus, the thimble 95, the cap 95, or a combination thereof may be cast, molded, assembled, or otherwise built as a monolith from a homogeneously formed material. Alternatively, the cap 95 may be divided into components constituting the thimble 95 and some covering portion that is part of the housing 94. In the illustrated embodiment, a cap 95 forms the thimble 95 integral thereto.

The aperture 96 passes through the cap 95 or thimble 95 as well as the housing 94 remainder. Thus, the axle 92 or bolt 92 may pass through the aperture 96 in order to secure the bail 90 to the housing 94, the thimble 95, and thus the upper loop 26*b*.

Referring to FIGS. 3A through 11P, while continuing to refer generally to FIGS. 1 through 21, in certain embodiments of an apparatus and method in accordance with the invention, an anchor system 12 may include a crossbar 20 configured as a head 20 or box 20 to be driven into a sea bed 72 at some distance below a surface 19 of a body of water. Typically, the crossbar 20 may be configured in any suitable shape, whether solid or hollow. However, certain benefits may accrue to different configurations. For example, if the rope 24 or line 24 and the loop 26*a* are engaged through a solid material of the crossbar 20, additional strength is available. If the loop 26*a* is actually woven back into the line 24, then the thimble 60 may be an integral portion formed within the material of the crossbar 20. However, in this configuration, the length of the line 24 must be determined in advance, or some amount must be cut off in service. Thus, much of the line 24 may be wasted.

On the other hand, a person performing an installation may select a rope size for the line 24, and then braid the line 24 back into its self to create the loop 26*a* on site. This requires a level of skill, an amount of time, and so forth that may be much less economical than a modular construction for assembly and installation in a limited amount of time, with a limited level of skill, and limited demand on tools and resources. In the illustrated embodiment, the aperture 67 may be formed, cast, cut, or otherwise made inside a top plate 21 formed as part of the crossbar 20.

For example, in one embodiment, the crossbar 20 may be an extruded shape. Thus, the bottom wall 102 need not be of the same thickness or the dimensions as the top wall 21. Typically, the side walls 104 would be of the same dimensions for purposes of economy and stability. In certain embodiments, the top wall 21 or top plate 21 may extend to a width wider than that of the bottom wall 102. Herein, top and bottom refer to the directions or relative positions of the walls 21, 102 with respect to the approximate installed position of anchor system 12.

Thus, for example, the dimensions of width, length, and thickness of the top wall 21 may be selected to provide the proper strength, stiffness, and other material properties needed to support the rocker 22 when loaded by the line 24 during setting of the anchor subsystem 12. Testing after setting imposes the maximum loading condition.

Likewise, the section modulus (used as that term is defined in structural engineering) of the overall box 20 or crossbar 20 may be designed by an engineered combination of wall lengths, thicknesses, and widths in any 3 of the dimensions. In the illustrated embodiment, the thickness in a vertical direction of the top wall 21 or top plate 21 is greater than that of any of the other walls 102, 104. However, in certain embodiments, the thimble 60 with its attendant plates 64 in the rocker 22 may actually be positioned in the lower wall 102, and inserted after drawing the loop 26*a* completely through the crossbar 20, before installation.

However, in the illustrated embodiment, the rocker 22 being positioned in the top wall 100 of the crossbar 20 provides a compliance of the line 24 and loop 26*a* to conform or deflect alongside the top wall 21 during the insertion process. Thus, the rocker 22 permits the loop 26 to readily displace about the thimble 60, and thus lay the rope 24 or line 24 directly along the top wall 21 during installation of the crossbar 20 beneath the sea bed 72.

The position of the rocker 22 in the top wall 21, provides clearance therebelow proximate the lower wall 102 for passage of the steel pipe 55 through the hollow portion of the crossbar 20, to be threaded into the threaded opening 59. Orientations and directions are with respect to the installed, horizontal position of the crossbar 20, not the approximately vertical, drilling position.

Figure 3A:
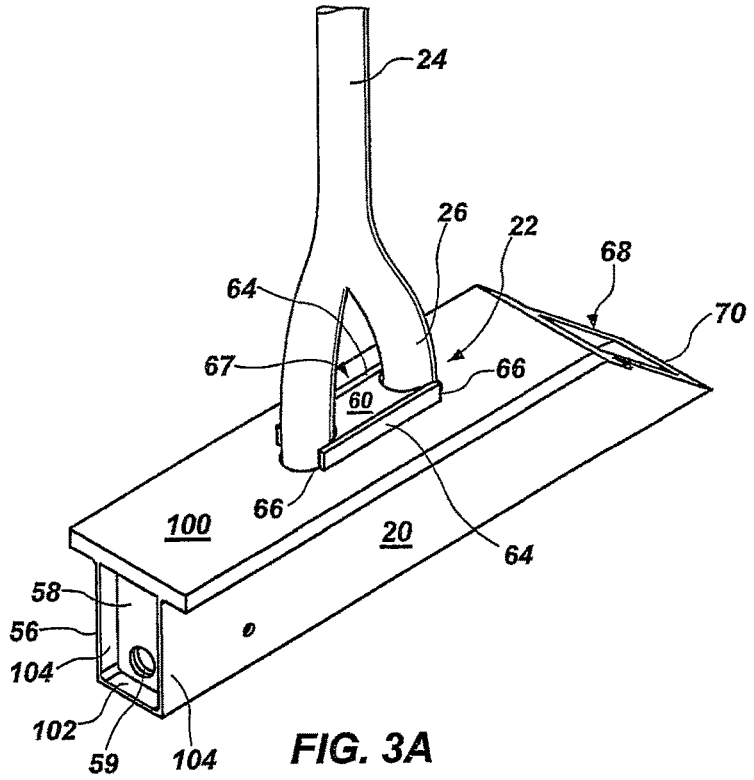
FIG. 3A is a leading end perspective view of an anchor portion of the system of FIG. 1.
Figure 3B:
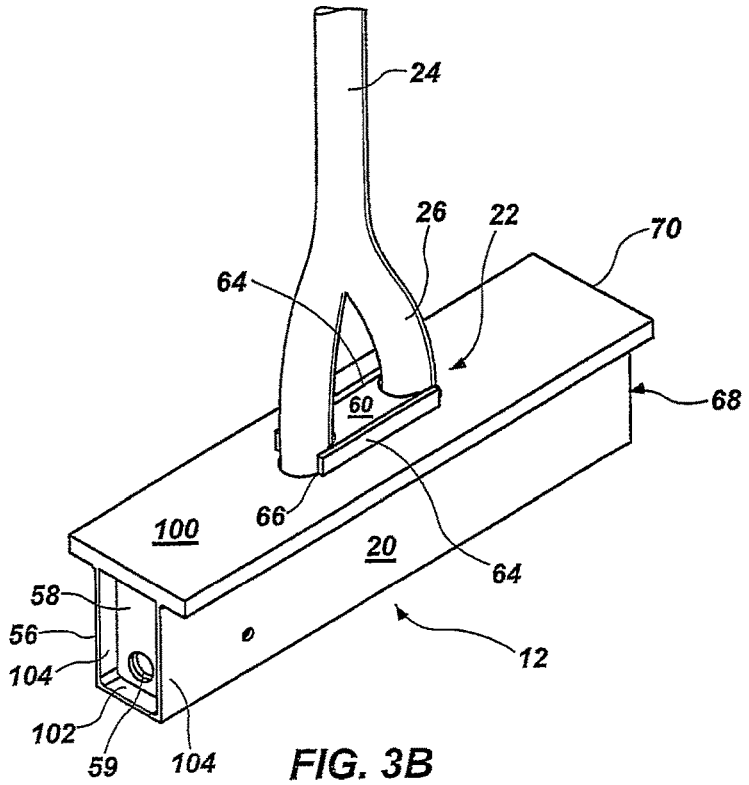
FIG. 3B is a perspective view of the subsystem of FIG. 3A, this using a sharp edge angled back toward the center of force rather than away therefrom as in FIG. 3A.
Figure 4:
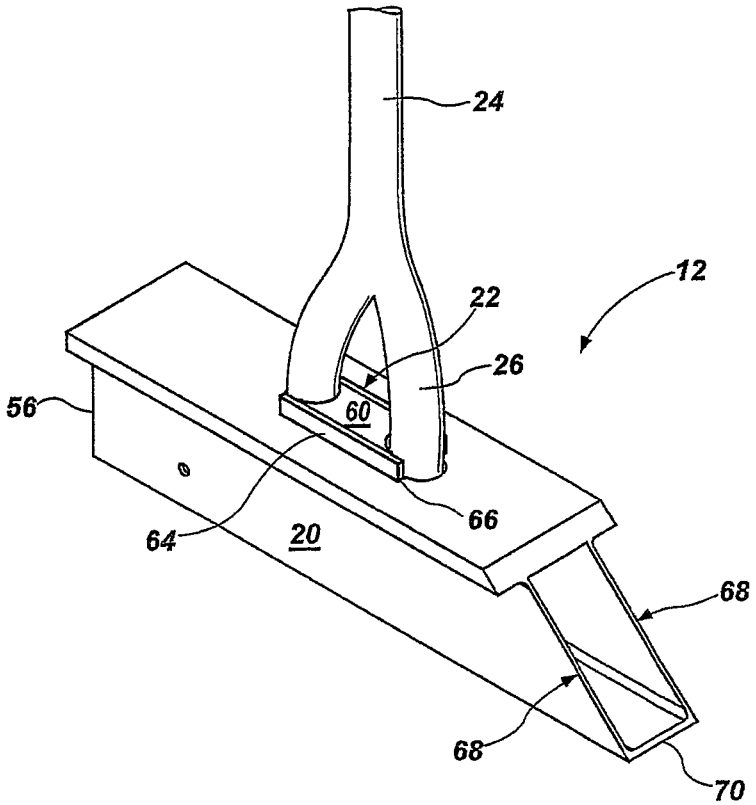
FIG. 4 is a trailing end perspective view of the anchor subsystem of FIG. 3A.

Likewise, as illustrated in FIG. 3B, the angle and orientation of the guide surface 68 may place the edge 70 at one end of the top wall 21. In contrast, the edge 70 in FIG. 3A is placed at one end of the bottom wall 102. Operation will be somewhat different for the crossbar 20 depending on the location of the edge 70. For example, in a configuration of FIG. 3A, the edge 70 is directed to catch on the bore 74 in the sea bed 72 much more readily. In contrast, the configuration of FIG. 3B requires that the crossbar 20 rock further out of its alignment with the bore 74 before the edge 70 can engage or catch in the wall of the bore 74.

On the other hand, with the reinforcement and stiffening of the top wall 21 by the presence of the side walls 104 and long wall 102, the strength and stiffness at the edge 70 in FIG. 3B is substantially greater than that of the edge 70 of FIG. 3A in the illustrated embodiments.

Figure 5:
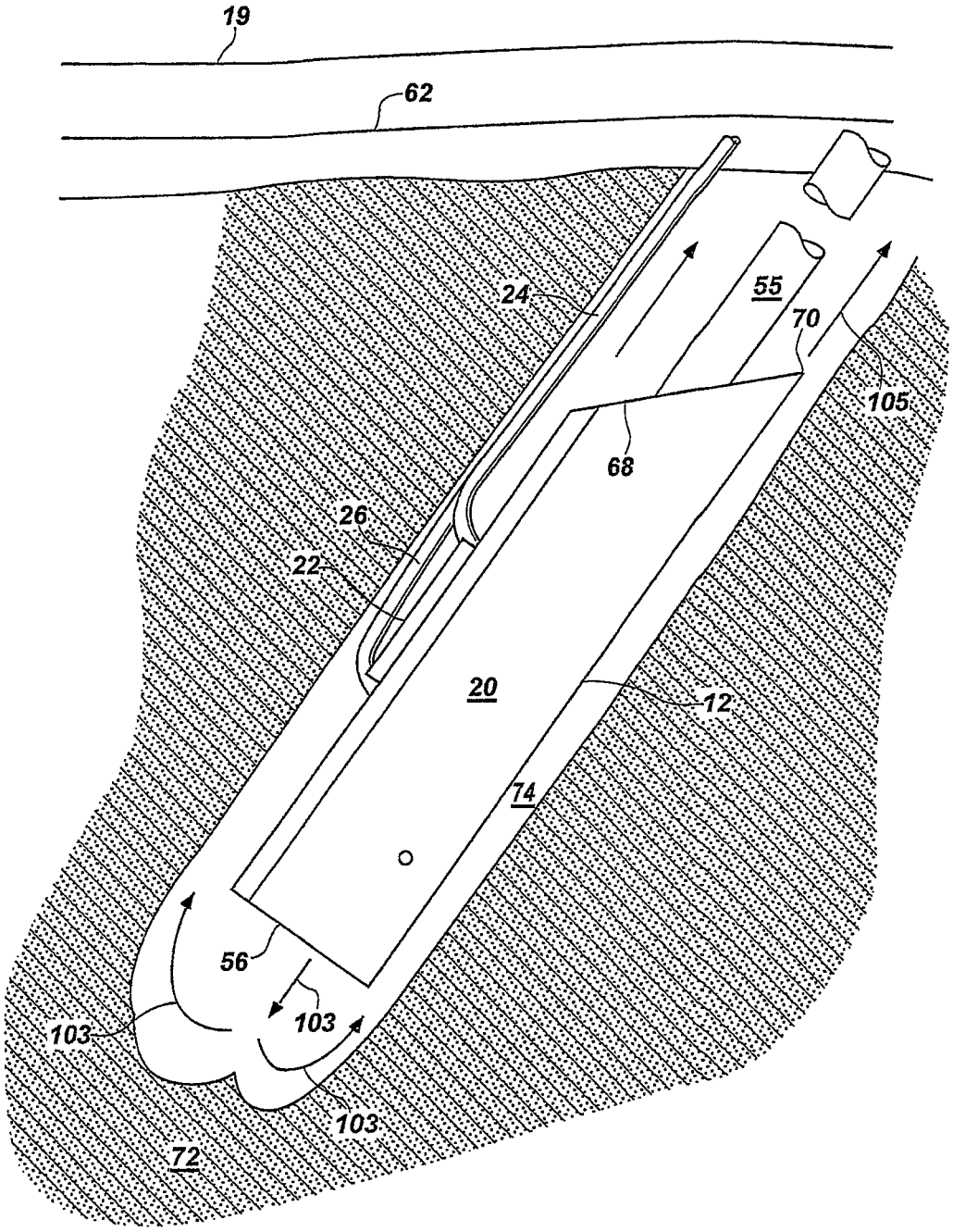
FIG. 5 is a side elevation, cut away view of a hydro-drilling process in accordance with the invention.
Figure 6:
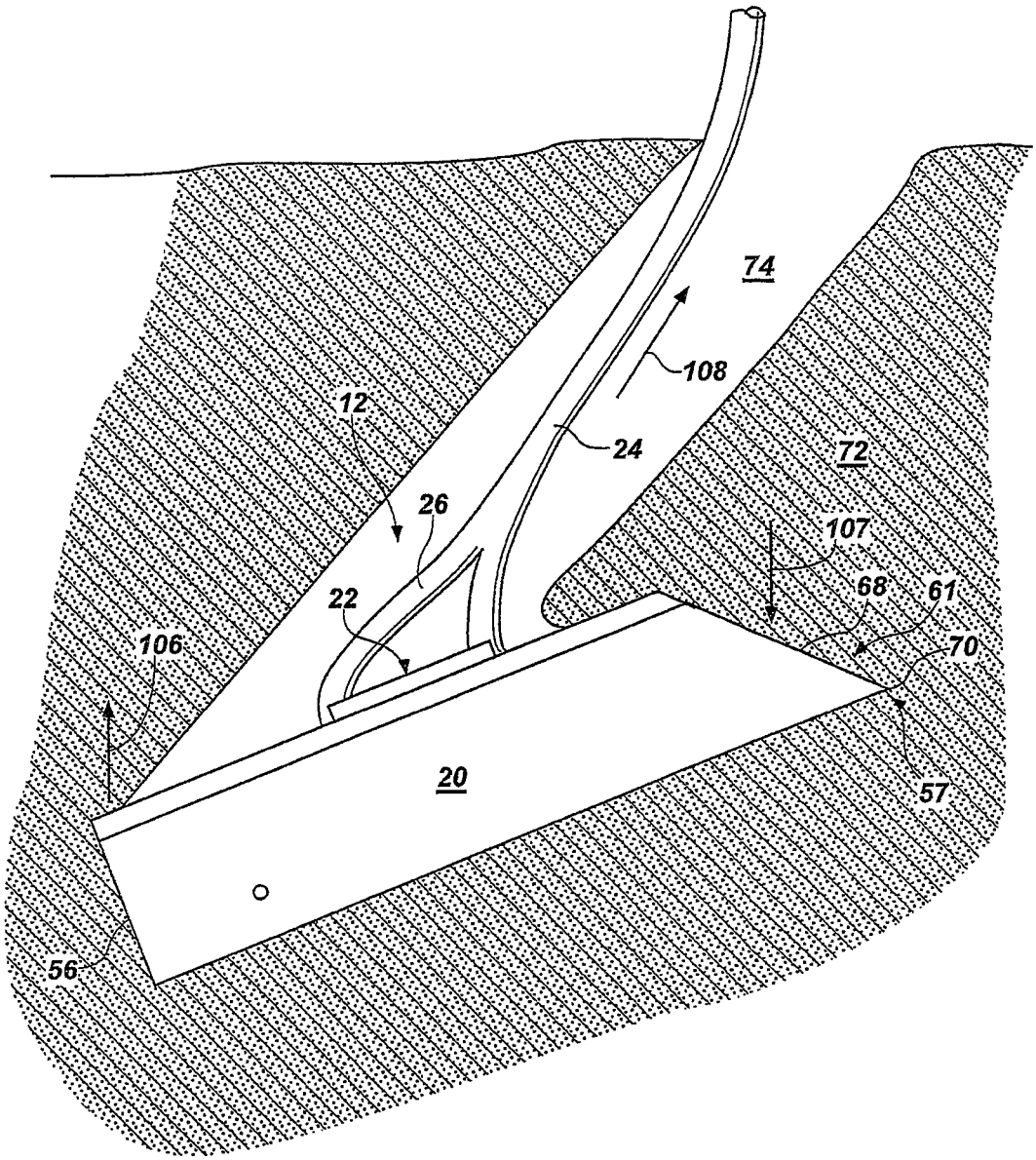
FIG. 6 is a side elevation, cut away view of the setting step in installation of a mooring system in accordance with the invention.

Referring to FIGS. 5 through 6, while continuing to refer generally to FIGS. 1 through 21, the hydraulic drilling process may rely on a worker to insert a metal or other pressurized fluidizing pipe 55 through the interior hollow space 61 of the crossbar 20 and threading the pipe 55 into the threaded aperture 59. It has been found that a pipe length of from about 10 to about 40 feet may be used. As a practical matter, a target length of about 20 feet has been found suitable in most mooring applications. Thus, with the sea bed surface 19 being about 6 to 12 feet below the surface in many mooring areas, such a size is fully suitable.

The steel pipe 55 may be of any suitable length needed, and its diameter should be engineered for column stiffness and water throughput. However, a target length of about 20 feet and an inch and a half nominal diameter have been found appropriate for mooring purposes. For example, most lakes, bays, harbors, and the like have a bottom that is comparatively "shallow draft" for a comparatively smaller craft. Accordingly, water depth is typically on the order of from about 5 to about 15 feet. Accordingly, a crossbar 20 may be embedded 5 or 6 feet under the surface 62 of the sea bed 72.

With a length of a pipe 55 much greater than about 20 feet, the pipe itself becomes unwieldy when operated from a craft on the surface 19 of the water. Similarly, the pipe 55 and attached crossbar 20 may be operated from the surface 19 from a watercraft, such as a working boat, tug, catamaran, or other craft, or may be operated from within the water.

However, as a practical matter, operating from a dry work station on a watercraft anchored well for stability has been shown to serve best.

The pipe 55 ejects a comparatively high volume and high pressure flow 103 axially 105 with respect to the length of the crossbar 20. This occurs during the drilling portion of the installation process. The crossbar 20 is oriented approximately perpendicularly to its insertion angle after being set. The jet 103 or flow 103 initiates in the direction 105 axially 105 with respect to the pipe 55 and crossbar 20. It immediately encounters and begins eroding the sea bed material 72 directly in front of (below with respect to the horizontal surface of the earth). The flow 103 erodes the material from the sea bed 72, fluidizing it and passing it back through the bore 74 surrounding the crossbar 20. Thus, the crossbar 20, which anchors the line 24, may also be referred to as a head 20 or drilling head 20. It serves both purposes.

Fluidization is the principle defined by the pressure within the bore 74 being of each entrained object sufficiently high to match the drag force required of fluid drag on a solid body in the flow 103. Thus, the pressure at the lead end 56 of the head 20 or crossbar 20 needs to be sufficiently high to provide impact energy sufficient to dislodge the material of the sea bed 72 near the lead end 56. Moreover, that pressure must also be sufficient to float out through the bore 74 in an upward direction, all of the loose debris cut away by the flow 103. Thus, the fluid dynamic drag around all of the material being eroded must be sufficiently high to lift and drift that material back up through the bore 74 to be deposited in the water directly above the surface 62 of the sea bed 72.

This fluidized bed approach provides improvements over prior art methods wherein jackhammers pounding underwater drive blades into the sea bed 72. Such systems provide high intensity shock waves, impact waves, or other pressure (e.g., compressing) waves through the surrounding water. Those compression waves may injure or otherwise influence an operator operating the jackhammer. In contrast, the fluidization process of the flow 103 is continuous, creates no impact, creates no significant compression waves propagated through the comparatively stiff (i.e, almost incompressible) water, thus preserving health and minimizing fatigue of an operator.

Moreover, in experiments, this fluidized hydraulic jet 103 has been found to drill a suitable bore 74 in a matter of minutes, typically about 5 or 6 minutes of total drilling time will bore from 5 to 20 feet in a typical non-rock substrate. Thus, an apparatus and method in accordance with the invention provide much more rapid drilling, less fatigue, less physiological damage to workers associated with the drilling and setting of the crossbar 20, and requiring much simpler equipment.

Also rotating, helical-screw-type embedding systems are complex, powerful, dangerous, and require multiple operators. Personnel requirements are also under water, adding time, complexity, and cost.

Here, the total equipment weight, the supporting equipment, and so forth are very different and substantially less. For example, a water pump mounted on a boat, suitably sized, rated, and adapted to use in the environment may provide a water source to the pipe 55. Water becomes the fluidizing agent for both erosion drilling and floating the excavated material out of the bore 74.

Referring to FIG. 6, setting the anchor may begin at substantially any time after the pipe 55 has been removed from the threaded opening 59 in the crossbar 20. The crossbar 20 must be able to tilt. In the illustrated embodiment, the edge 70 is tipped into the side of the bore 74 immediately by several factors. One of those factors may be the eccentricity of the rocker 22 positioned in the crossbar 20. By arranging that position to be off centered, the fluid drag and material drag on the trailing end 57 of the crossbar 20 may be increased or its leverage may be increased for the benefit of the trailing end 57 compared to the lead end 56. Likewise, the edge 70 is comparatively sharp. Corners of it will catch the wall of the bore 74. Being formed of a polymeric material, the crossbar 20 need not have an edge 70 that is hardened and sharpened like a steel implement.

Typically, it is not required that the edge 70 cut into either the lower or higher surface of the bore 74. The line 24 will tend to draw the crossbar 20 upward along the bore 74. However, the edge 70 will immediately catch in the material 72 of the sea bed 72 and immediately begin to penetrate laterally (e.g., orthogonally) with respect to the axial direction 101 of the bore 74, applying a force 107 to the material 72 further embedding the crossbar 20 therein.

A reaction immediately occurs at the lead end 56, which now exerts a force 106 upward and into the sea bed 72. This force 106 as exerted by the lead end 56, will eventually result in the edge 70 being driven further into the sea bed 72, in a direction away from the vacant bore 74. Thus, both ends 56, 57 of the crossbar 20 will begin to plow into the sea bed 72 as the line 24 exerts a force 108 upward along the line 24, in the bore 74. A certain amount of the sea bed 72 will thus be excavated above the crossbar 20, filling in the bore 74 therebelow and thereabove.

Over time, beginning immediately, the bore 74 will refill. It becomes largely reconsolidated within a matter of a few weeks. Heavy materials, including shells, rock, sand, soil, and the like within the sea bed 72 will fall into the bore 74. Accordingly, the bore 74 will pack quite completely and firmly, consistent with the surrounding sea bed 72. However, it has been found that a setting process as illustrated in FIG. 6 renders the crossbar 20 immediately fixed within the sea bed 72, and capable of supporting thousands of pounds. Thus, the downward force 110 of the sea bed 72 acting on both the lead end 56 and the trailing end 57 balances and supports the tensile force 108 in the line 24 during the setting process, as well as during the mooring or other utilitarian service of the anchor subsystem 12 and the overall system 10.

Figure 7:
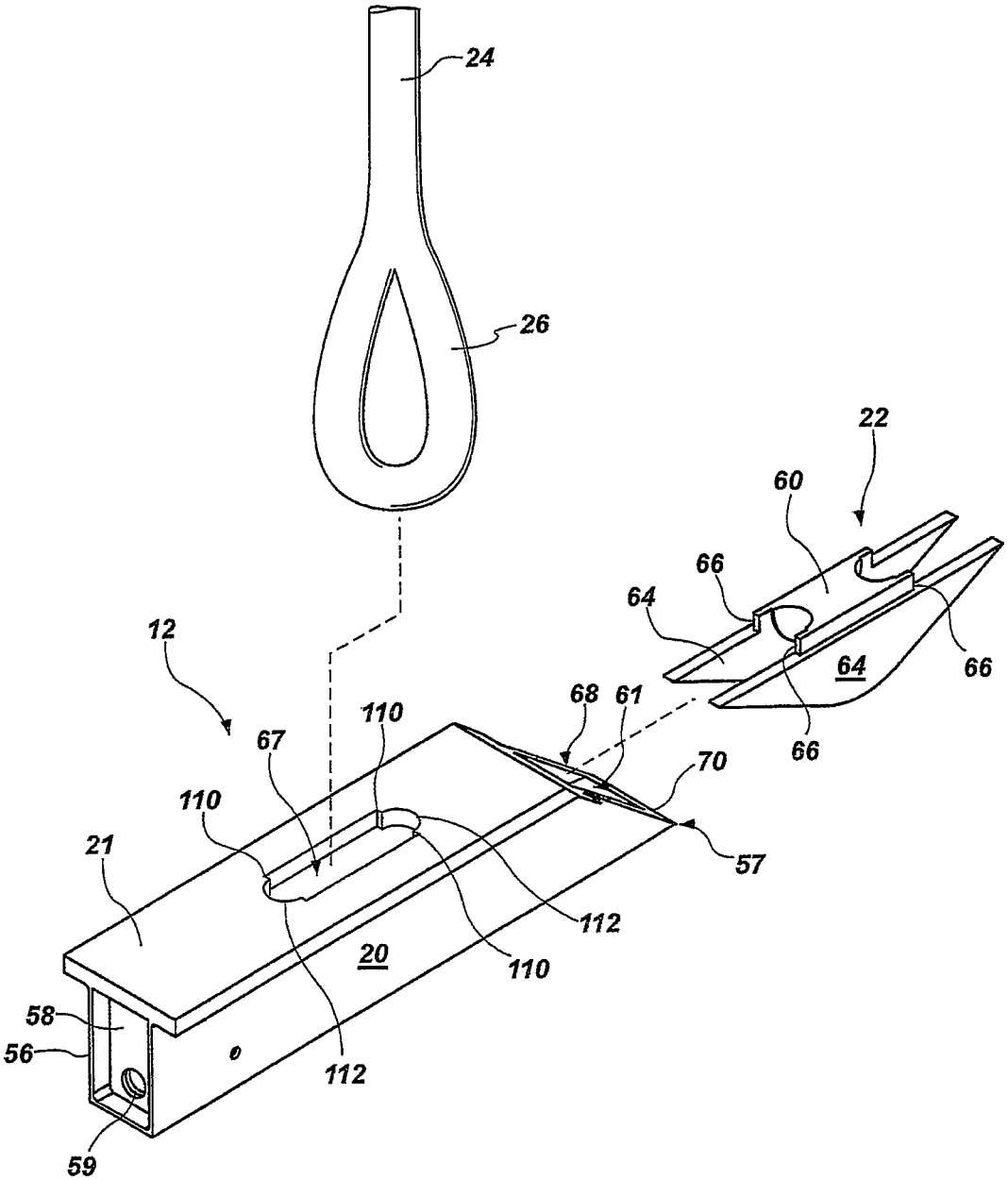
FIG. 7 is a perspective, exploded view of the anchor subsystem of FIGS. 1 through 6.
Figure 8A:
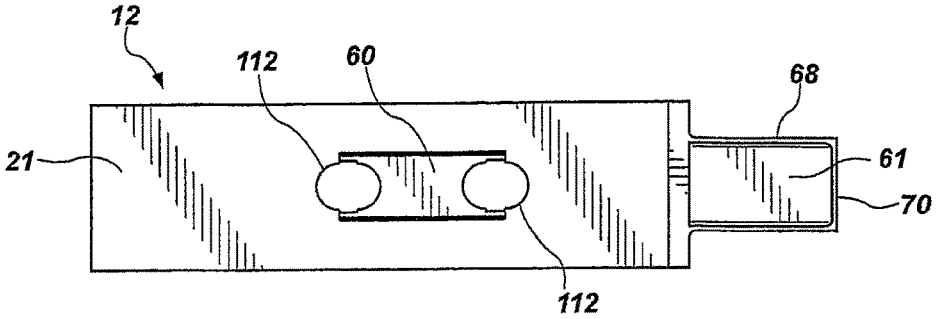
FIG. 8A is a top plan view of the anchor box of FIG. 7.
Figure 8B:
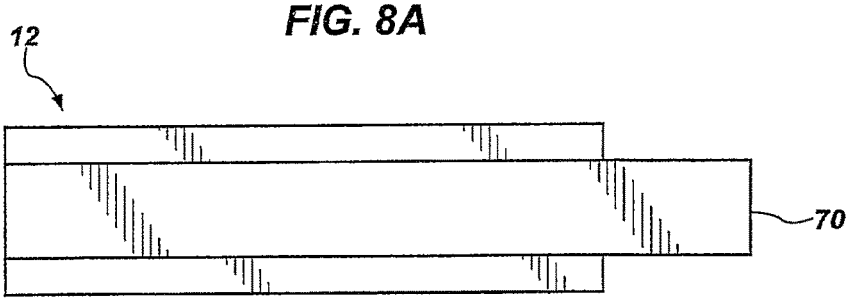
FIG. 8B is a bottom plan view thereof.
Figure 8C:
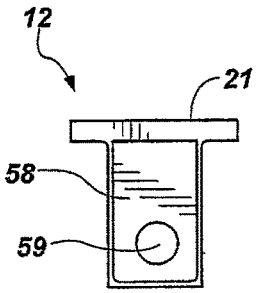
FIG. 8C is a front elevation view thereof.
Figure 8D:
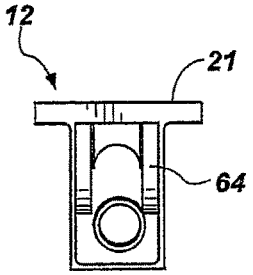
FIG. 8D is a rear or trailing end elevation view thereof.
Figure 8E:
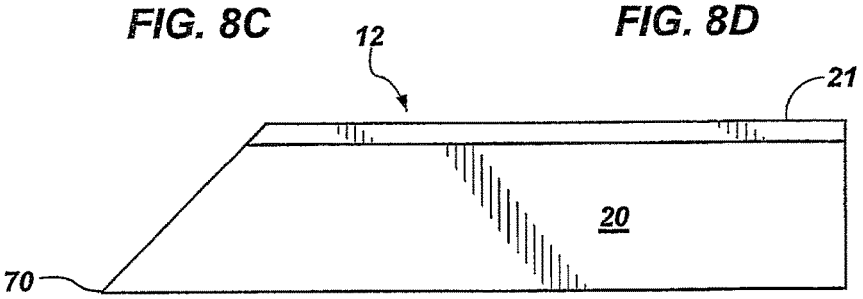
FIG. 8E is a left side elevation view thereof.
Figure 8F:
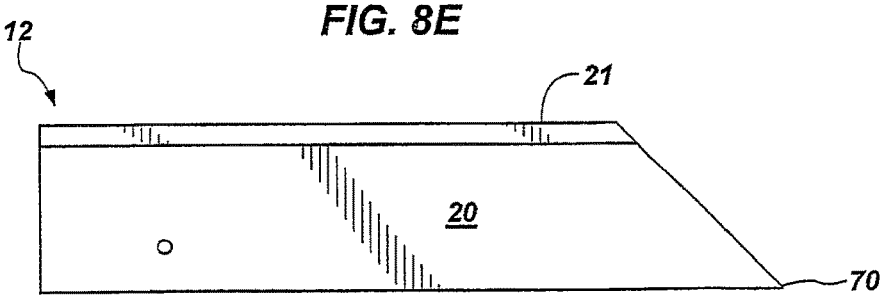
FIG. 8F is a right side elevation view thereof.
Figure 9A:
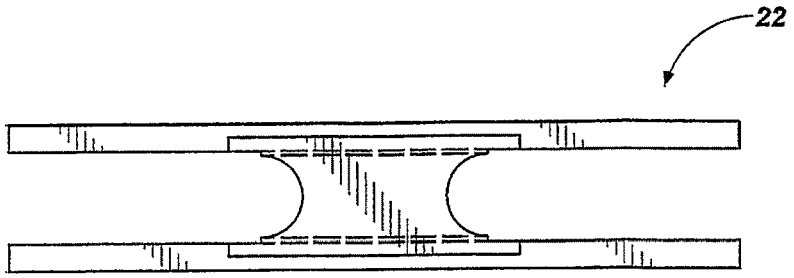
FIG. 9A is a top plan view of the thimble and rocker system of FIG. 7.
Figure 9B:
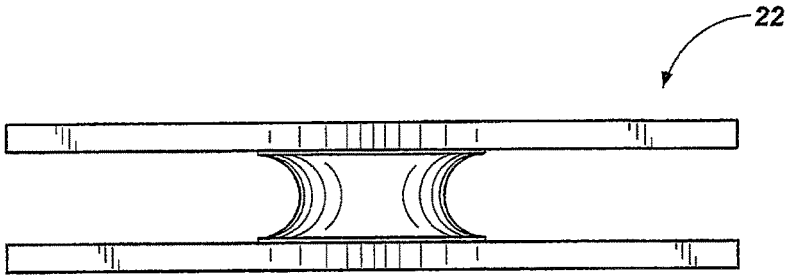
FIG. 9B is a bottom plan view thereof.
Figure 9C:
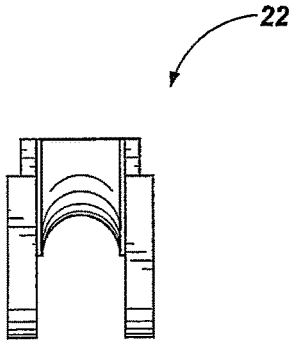
FIG. 9C is a side elevation view thereof, the right side elevation view being identical thereto.
Figure 9D:
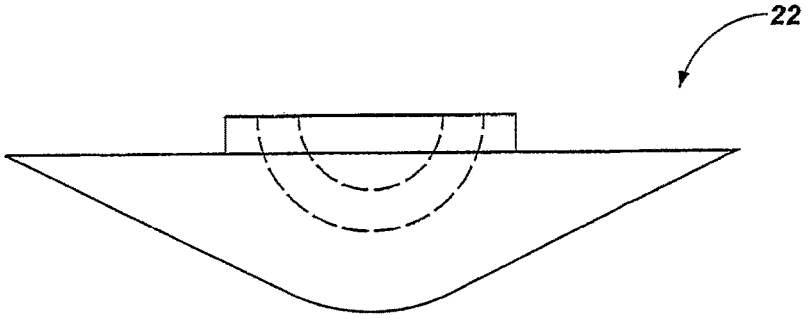
FIG. 9D is an end elevation view thereof, the view from both ends thereof being identical.

Referring to FIG. 7, while continuing to refer generally to FIGS. 1 through 21, an exploded view of the anchor subsystem 12 illustrates the orientation of each of the parts and their respective relationships to one another. The line 24 is inserted into the aperture 67 and out the channel 61 or hollow 61 in the crossbar 20. The loop 26 of the line 24 is typically formed by re-braiding the line 24 back into its self to form the loop 26. Thus, an integrated, comparatively low stress configuration exists in the load path within the line 24 and loop 26.

The loop 26 is manipulated around one of the shear plates 64, and positioned around the circumference of the thimble 60. The loop 26, is then turned back to thread the line 24 and loop 26 back in through the passage 61 or channel 61 until the rocker 22 is directly below or near the aperture 67. The shoulders 66 fit into the corners 110 of the aperture 67.

The shoulders 66 of the shear plates 64 register in two dimensions within the corners 110 of the aperture 67 to position the thimble 60 and loop 26. Once properly registered, the concavity of the thimble 60 is matched with the end loops 112 of the aperture 67 to conduct the loop 26 out through the top plate 21 of the crossbar 20. Thus, the loop 26 is free to move and adjust its circumferential position about the thimble 60. In this way, during the drilling process, the lead end 56 may be oriented approximately downward at some particular angle of near vertical. The loop 26 may be rotated about the thimble 60 in order to lay the line 24 alongside the top plate 21 or top wall 21 of the crossbar 20.

Referring to FIGS. 8A through 8F, the various views of the crossbar 20 are illustrated for clarity. Thus, each of the orthogonal views is visible.

Referring to FIGS. 9A through 9D, the various views of the rocker 22 are illustrated, showing the relationships between the shear plates 64, the thimble 60, the shoulders 66, and so forth. Typical dimensions of the line 24, and loop 26 may be from about ½ inch to about 2 inches in diameter of the line 24, and a loop 26 having an inner circumference of from about 8 inches to about 1 foot. Typically, the line 24 has about a 1 to 1 ¼ inch diameter, and the inner circumference of the loop 26 is approximately 1 foot. Accordingly, the loops 112 or arcs 112 of the aperture 67 are similarly sized. They may be rounded along their edges, and may be over sized to accommodate the loop 26. However, it has not been found problematic to leave the sharp edges, as they do not appear to cause significant damage to the loop 26 in service.

Figure 10:
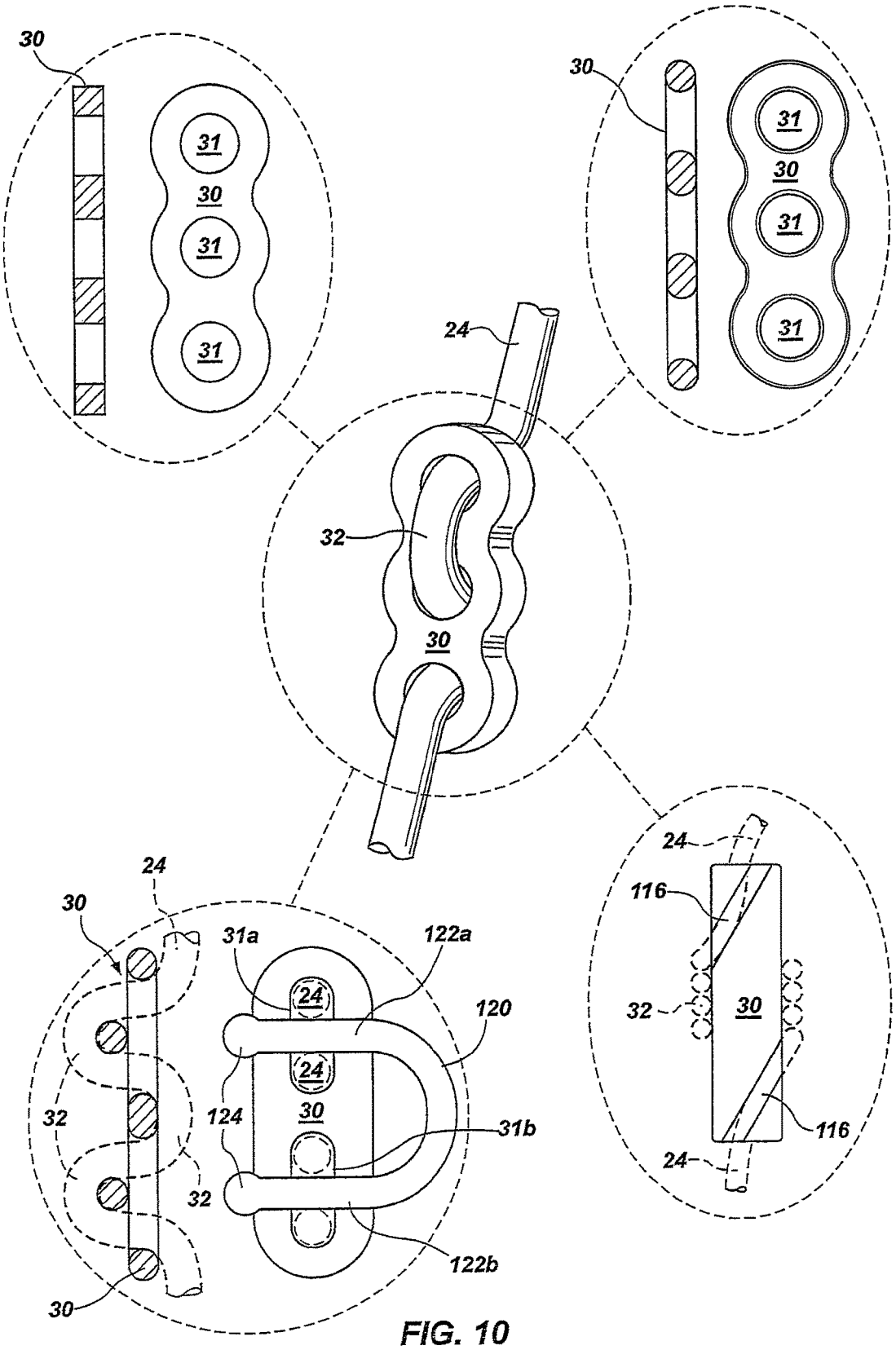
FIG. 10 is a perspective view of one embodiment of a worm grip in accordance with the invention, and illustrating various alternative front elevation views and side elevation views of those alternative embodiments.
Figure 11A:
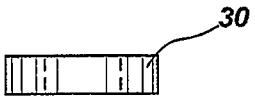
FIG. 11A is a top plan view of one embodiment of a work grip.
Figure 11B:
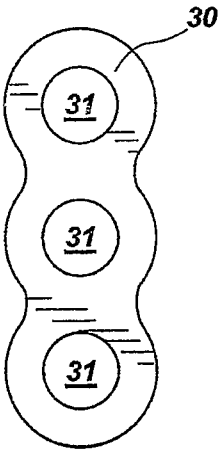
FIG. 11B is a front elevation view thereof, the rear view being unnecessary as identical thereto.
Figure 11C:
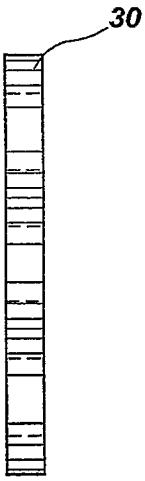
FIG. 11C is a side elevation view thereof, both the right and left side views being identical to one another.
Figure 11D:
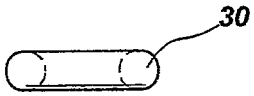
FIG. 11D is a top plan view of an alternative embodiment of a worm grip.
Figure 11E:
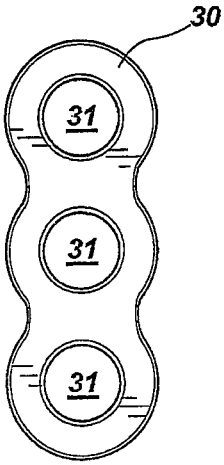
FIG. 11E is a front elevation view thereof, the rear elevation view being identical.
Figure 11F:
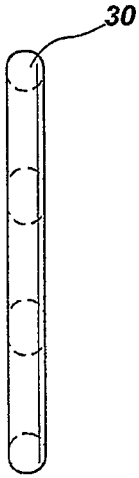
FIG. 11F is a side elevation view thereof, the right and left side views both being identical to one another.
Figure 11G:
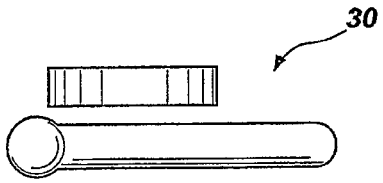
FIG. 11G is a top plan view of an alternative embodiment of a worm grip, this being adapted to use after a line, rope, rode is already in place; the bottom plan view is a mirror image of the top plan view.
Figure 11H:
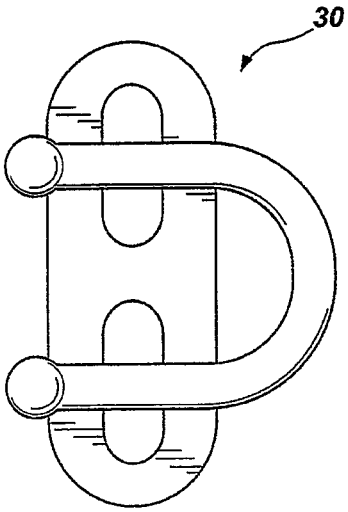
FIG. 11H is a front elevation view thereof; and the rear elevation view is a mirror image except that the u-shaped member is partially obscure.
Figure 11J:
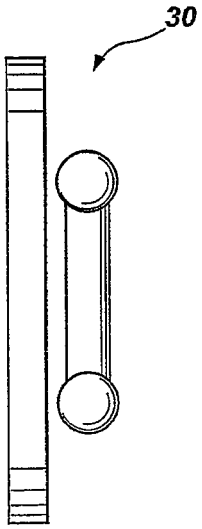
FIG. 11J is a left side elevation view thereof, the right side elevation view being a mirror image, but the u-shaped member obscuring the detents somewhat.
Figure 11K:
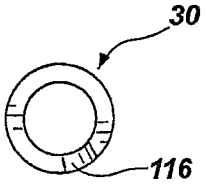
FIG. 11K is a top end view of a cylindrical alternative embodiment of a worm grip.
Figure 11L:
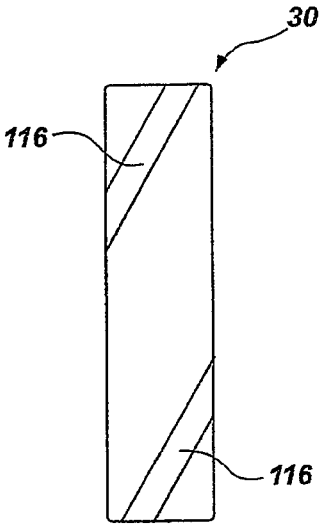
FIG. 11L is a front elevation view thereof.
Figure 11M:
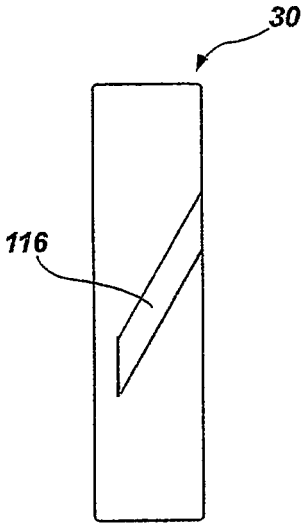
FIG. 11M is a left side elevation view thereof.
Figure 11N:
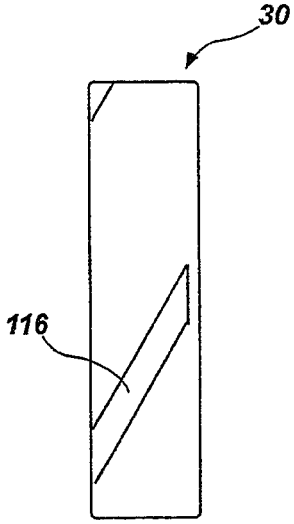
FIG. 11N is a right side elevation view thereof.
Figure 11P:
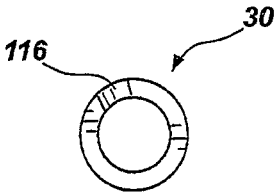
FIG. 11P is a bottom end plan view thereof.
Figure 12:
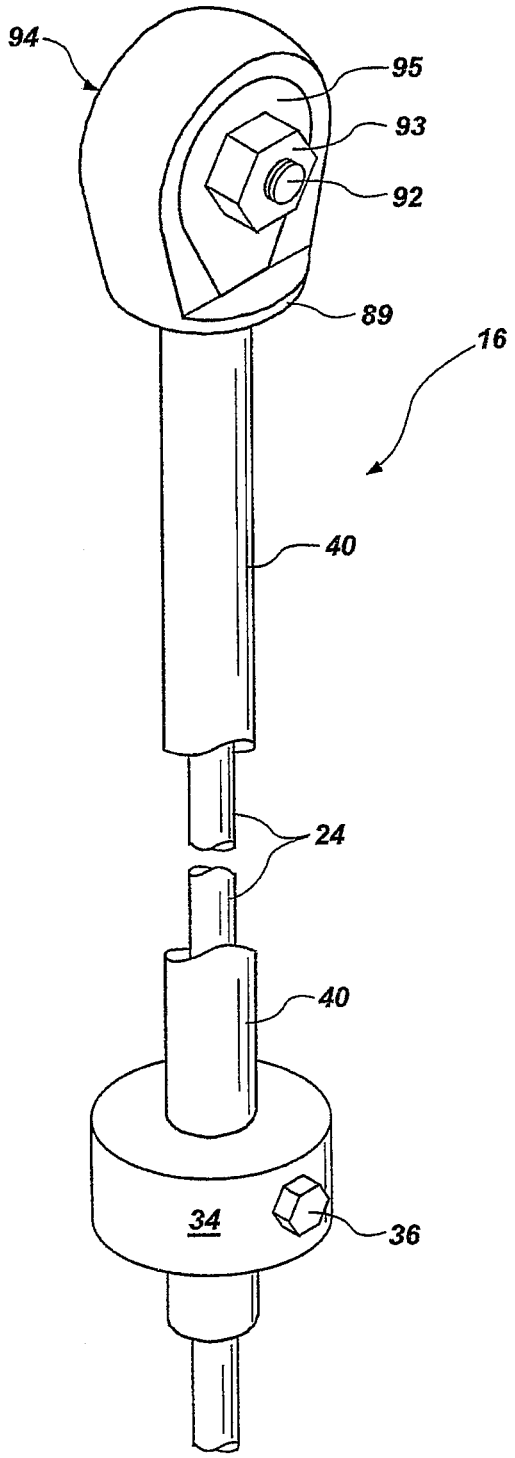
FIG. 12 is a perspective view of the upright subsystem.

Referring to FIGS. 10 through 11P, a worm grip 30 or stop 30 may be manufactured and implemented in any of a variety of configurations. For example, the grip 30 will typically include several apertures 31. Typically, at least two apertures, and sometimes three or more may be important for inducing sufficient friction in the line 24 to resist or even preclude motion by the line 24 through the grip 30. Multiple illustrated embodiments may be viewed clockwise from the upper left of FIG. 10. In the upper left embodiment, the grip 30 may include three apertures 31 in a plate 30 or grip 30 having edges that are nearly squared. These are typically only relieved with a slight chamfer. It has been found that the grip 30 may be formed of a comparatively rigid and strong polymeric material, including various versions of reinforced and non-reinforced polyethylene, polypropylene, or the like.

The apertures 31 may be aligned such that the center of each is on a line passing between all three apertures. 31. Alternatively, the apertures 31 may be offset, such as in a triangle. However, an important principle of operation of the stop 30 or worm grip 30 is that the line 24 should not be subjected to a tensile force that would tend to reduce the rating for the operating load that the line 24 may carry.

For example, proceeding clockwise to the upper right configuration of FIG. 10, here, the apertures 31 may be configured such that the remaining material in the stop 30 is completely smoothed to a specific radius selected to optimize the grip 30 by the stop 30 operating on the line 24, without increasing significantly or above a specified value preselected, the tensile force to which the line 24 is exposed.

Mountaineering, sailing, pioneering, and so forth make extensive use of lines 24, typically formed of rope. Rope may be braided, laid, or otherwise manufactured. Laid rope is the familiar twisted line in which bundles of fibers are twisted in one direction, and then in response lay together in the opposite direction. Laid ropes may become unlaid by the continual operation of water on the line 24 surrounding a mid-line float 28. Therefor, in one currently contemplated embodiment, the line 24 is formed of a braided rope.

In either mode, braided or laid, a line 24 passes through one aperture 31*a*, and then back the other direction through an adjacent aperture 31*b*, after which the line 24 changes direction to pass back through a final aperture 31*c*. The thickness of the stop 30 may be selected, and the diameters of the apertures 31 may be selected to provide between the apertures 31 a radius or diameter preselected to provide excellent service and no significant or unwarranted decreases in permissible tensile strength.

Knots have an inherent failure to maintain the internal circumference in a loop 32 of a line 24, such as the convolutions 32. One reason is because the line 24, itself, may not here be displaced, distorted, or otherwise deflected to the internal diameter or radius through such a convolution 32 would turn in a knot. Thus, by providing the solid material of the grip 30, a minimum internal diameter and radius are imposed, thus protecting the line 24 against excessive tensioning in the outermost surface fibers thereof.

Proceeding clockwise to the lower right configuration, a tube may be provided with slots. The slots need only pass helically a short portion of the length from one end, passing in a helical direction toward the other end. Rotation about the circumference of the tube encompasses from about 90 to about 270 degrees. It has been found that 180 degrees is a satisfactory included angle in each of the helices 116. The line 24 is shown as a broken line, merely to illustrate the operation of the stop 30. A line 24 may enter one end of the tubular structure of the stop 30, pass out from the inner cavity of the tube 30 to then wrap in one or more convolutions 32 or coils 32, directed toward the opposite end of the tube 30.

Near the opposite end, the line 24 continues by passing into a helix 116 or helical slot 116 at that opposite end. It may then pass out through the internal cavity of that tube 30. The flexibility of the line 24 provides certain relief from excessive tensile stresses in the line 24. Moreover, by selecting the length of the tube 30 acting as a grip 30, and thereby providing a corresponding lesser (e.g., longer) pitch angle, or a more shallow pitch angle and longer run for each convolution 32, stresses may be minimized in this configuration.

Proceeding clockwise to the lower left configuration, the stop 30 may be augmented by a pin 120. Here, the pin 120 includes multiple legs 122. As a practical matter, the pin 120 may be constituted by a simple leg 122. The grip 30 may be paired with a set of pins 122 or legs 122 installed by looping convolutions 32 of the line 24 through each of the oblong or extended slots 31. Here, rather than having circular configurations, the slots 31 may be oval or more oblong and sized to pass two diameters of line 24 therethrough.

For example, each of the configurations of FIG. 10, or alternative embodiments, is shown with a side cross-sectional view on the left and a front elevation view on the right. The convolutions 32 in the line 24 may pass through the aperture 31, loop around a leg 122 of the pin 120 (here the U-shaped member 120) and then pass back through the same aperture 31.

Immediately thereafter, the line 24 passes to the adjacent aperture 31, passing up and around the corresponding leg 122 of the pin 120, before passing back through that other aperture 31. Again, the trailing letters a and b following the aperture designation 31 indicate specific instances of the aperture 31. Thus, the line 24 passes out of the paper through the aperture 31*a*, around the leg 122*a* and back through the aperture 31*a*. Thereafter, the line 24 passes out of the paper, through the aperture 31*b*, circumnavigates the leg 122*b*, and passes back into the paper through the same aperture 31*b*.

Again, the diameter of the legs 122, the angles or smoothing or rounding of the edges of the apertures 31*a*, 31*b*, the detent ends 124, and so forth may be designed and selected such that the control is asserted to limit the minimum diameter any convolution 32 of the line 24 is permitted to assume when formed. By this mechanism, friction is sufficiently increased that the line 24 will not move after being installed properly through the apertures 31 of the grip 30. In this illustrated configuration, the grip 30 may be placed on a line 24 that has already been installed, and already has a float or other encumbrances attached thereto.

By comparison, the configuration in the lower right corner may likewise be placed on a line 24 that is already in place. In contrast, a line 24 must be threaded through using an open or "free" end thereof in the upper left and upper right configurations.

Referring to FIGS. 11A through 11B, while continuing to refer generally to FIGS. 1 through 21, one may see the various orthogonal views corresponding to each of the configurations illustrated in FIG. 10. Thus, one may design a stop 30 according to the size of the line 24 to be serviced, the load expectations that will be experience by the line 24, and the specification of a manufacturer of the line 24 as to the minimum internal diameter of a convolution 32 thereof, the size of the apertures 31 required, and so forth.

Referring to FIGS. 12, 13, and 14A through 14E, an upright subsystem 16 may be formed to receive the line 24 and loop 26*b* for the system 10. In the illustrated embodiment, the column 40 may extend a distance from a buoy 50 down through the buoy 50 and into the water below the surface 19. Typically, the distance between the flange 89 or bearing plate 89 at the upper end of the shaft 40 and the collar 34, which will typically be a weight 34, at the lower end of the column 40, may be from about 4 to about 12 feet. However, a target distance of about 6 feet, and typically running from about 5 to about 7 feet provides sufficient leverage against a buoy 50 to maintain the buoy upright.

The weight 34 is on the order of from about 4 to about 15 pounds. It has been found that a weight of from about 6 to 10 pounds is very serviceable. The collar 34 may be retained on the column 40 or shaft 40 by a retainer 36. A bolt 36, pin 36, clip 36, rivet 36, or the like may serve adequately. Typically, it is preferable that the retainer 36 not be formed of metal. One reason for this is that the collar 34 may suitably be formed of metal, such as lead. The presence of no other metals in the area minimizes corrosion to the metal 34, by precluding or resisting galvanic action.

Typically, the upright system 16 includes a housing 94. The housing 94 may be formed by any suitable method, but is typically well suited to manufacture by plastic molding. The housing 94 may include a collar, threaded pipe fitting, threaded aperture, solvent bond, spin weld, or the like in order to secure the column 40 thereto. Typically, extruded pipe 40 or tubing 40 is available to serve the function of the column 40.

In contrast, the housing 94 needs a particular shape that may or may not be commercially available. Similarly, the flange 89 may be formed to secure to the housing 94 and column 40 by molding, machining, threading, gluing, or other aforementioned manufacturing and securement method. Of course, the column 40, flange 89, and housing 94 may be formed (e.g., molded homogeneously of one material, at one time) as a single piece, but the manufacturing cost and complexity would be unnecessarily increased.

The upright subsystem 16 will typically include a cap 95, which may suitably be formed, molded, assembled, or otherwise fabricated as an integrated piece 95. If integrated, then the cap 95 actually forms, and should be called, the thimble 95 receiving the upper loop 26*b* of the line 24. The upper loop 26*b* may be identical to the loop 26*a* that secures the anchor subsystem 12 into the system 10. However, this is not necessarily so. However, it is inefficient to have the line 24 change diameters, as that would change the load rating.

The aperture 96 passing through the housing 94, including the cap 95 or thimble 95 may receive a bolt 92 secured by a nut 93 as a retainer 92. Similarly, the retainer 92 may be a pin 92, rivet 92, or other mechanism 92. One requirement for the retainer 92 is that it carry the full load and should be so specified, designed, selected, and implemented. Thus, the retainer 92 may be a steel bolt 92, a plastic rod 92, a plastic bolt 92, or the like. However, the full load of the line 24 will be born by the retainer 92, which supports the upper loop 26*b* in the line 24.

Referring to FIGS. 14A through 14E, the various orthogonal views of the assembled upright subsystem 16 are illustrated. The comparative length of the column 40 being substantially larger than its diameter, and an order of magnitude or more greater than any significant dimension of the housing 94, necessitates an interrupted length shown symbolically in the illustrations.

Referring to FIG. 15, an exploded view of the upright system 16 and the buoy subsystem 18 illustrates the relationship between the upright subsystem 16 and the buoy subsystem 18 when cooperatively engaged. In this embodiment, a pole 46, such as a painter pole 46 is illustrated, demonstrating a support 45 (e.g., flange, bearing, collar, etc.) and some type of retainer 47 or securement 47, which may be optional for the pole 46.

As described hereinabove, a capture 48, shown here to include both a hook 48 and a loop 48, may include a hook 48, a loop 48, or both 48. Similarly, the retainer 47 or securement 47 need not be used or required in certain embodiments. For example, the pole 46 may be used by engaging the capture 48 from above, and thus lifting the buoy 50 in order to access the ring 38 acting as a tie member 38 for mooring a watercraft. If so, then the retainer 47, illustrated here as a threaded nut 47, will be valuable.

Alternatively, the pole 46 may be threaded, and the bore 44 may be threaded at its lower extremity. So the pole 46 is captured therein. A collar, spin welding, solvent bonding, a pin, or some combination may serve as well or instead. Regardless of mechanical configuration, the pole 46 may be a permanent fixture by which the buoy 50 can be lifted, or may be removable therefrom to use the capture 48 as a grapple mechanism on a removable (from the buoy) pole 46, to gain access to the tie 38 or mooring ring 38.

Referring to FIGS. 15 through 18, and FIGS. 19A through 19D, one may understand the buoy subsystem 18 as including an outer wall 82. The wall 82 may extend to the bore 86. Both may be simultaneously formed in a suitable process, such as blow molding, roto-molding, or the like, as known in the art. Typically, reaction injection molding may form an outer skin 82 or wall 82 that has a fill material 84 naturally created as part and parcel of the molding process. However, in one presently contemplated embodiment, roto-molding provides a closed mold in which may be formed the entire outer wall 82, contiguous and continuous with the inner bore 86 or central bore 86, with the associated recess 42, central seat 87, and so forth.

In the illustrated embodiment, the seats 88 may be formed simultaneously with the overall outer wall 82, and may provide marking and access to the interior of the buoy 50 by drilling through them. Thereafter, a fill material 84 may be injected, such as a foamed plastic 84, or the like. Typically, a closed cell foam 84 may be best used. It should be selected to be robust, typically somewhat flexible, but resistant to attack by chemicals, salt, microorganisms, plant life, animal life, and so forth. The outer bores 44 or ancillary bores 44 may be drilled through the fill material 84.

Figure 18:
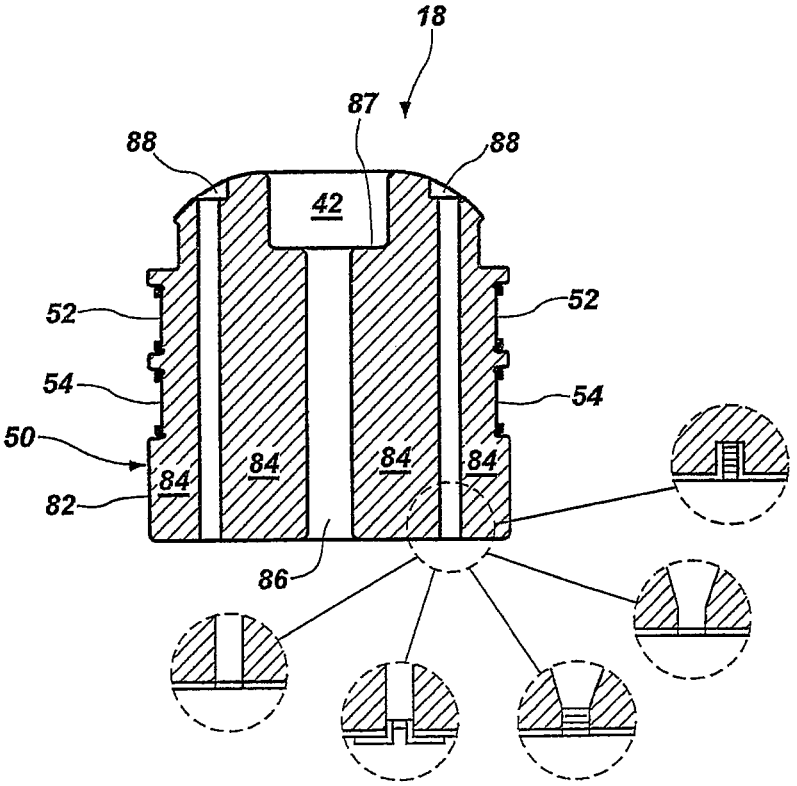
FIG. 18 is a cross-sectional, side elevation view thereof.
Figure 19A:
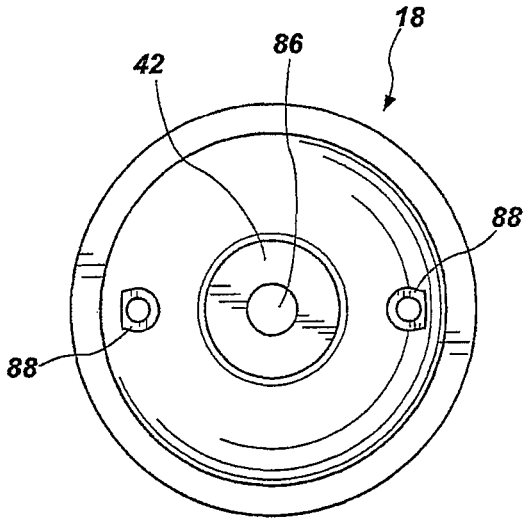
FIG. 19A is a top plan view thereof.
Figure 19B:
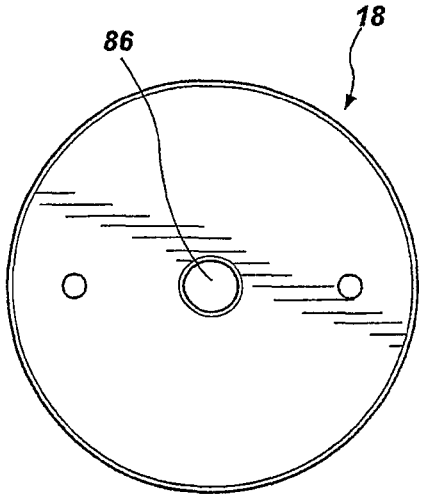
FIG. 19B is a bottom plan view thereof.
Figure 19C:
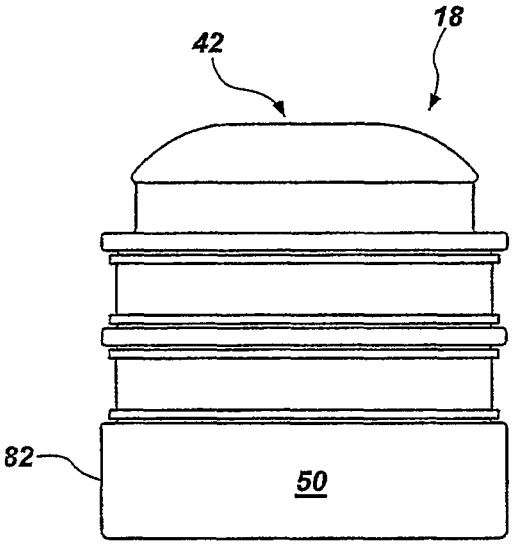
FIG. 19C is a front elevation view thereof, with no rear elevation view required, as being identical.
Figure 19D:
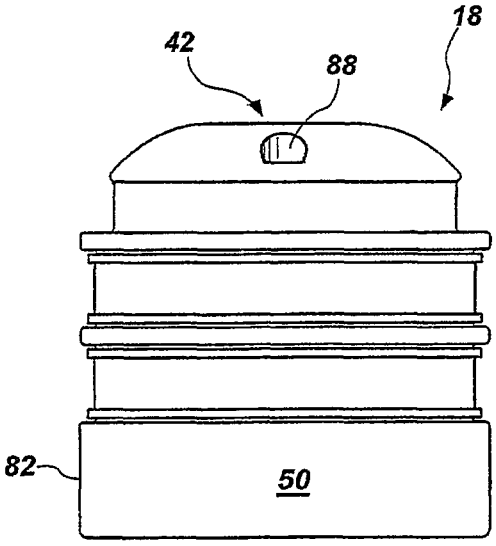
FIG. 19D is a side elevation view, there being no need for another side, as both sides, right and left, are identical.

Referring to FIG. 18, various interfaces 126 or receivers 126 are shown at the bottom of the ancillary bore 44. Thus, threads may be molded in, later prepared, or the like. Similarly, a taper 126, boss 126, flange 126, or the like may be installed as a keeper 126 to receive and secure a lower end of a pole 46.

In the illustrated embodiment, the buoy 50 is provided with a higher marker 52 and a lower marker 54. Typically, certain requirements are made of the high marker 52, such as the display of certain codes, numbers, text, or the like. Accordingly, the marker 52 may be provided a slot 127 defined suitably to recess into the wall 82 of the buoy 50. In this way, a set of text characters (alphabetical, numerical, or both), signage, or the like may be inserted into the slot 127. A strip may contain a regulatory color code for the lower marker 54, as a strip of alphanumerical characters may provide the upper marker 52. In either event, each slot 127 may be created with a lip 125 above, one below, and preferably both, with respect to the slot 127. One may think of the lip 125 as defining the slot 127, and providing a capture mechanism. As a practical matter, the markers 52, 54 may simply be riveted by a suitable plastic attachment mechanism or a metal pop rivet, or other mechanism within a slot 127 or recess 127 circumscribing the buoy 50. Thus, abrasion, impact, and other influences are minimized from damaging or removing the markings 52, 54 of the markers 52, 54.

Referring to FIGS. 19A through 19D, the various orthogonal views are presented to understand the appearance of the design of the buoy 50. One will note the hemispherical top surface for the wall 82 as illustrated. The hemisphere is necessarily truncated by the presence of the recess 42. In other embodiments, the rounded shape may be replaced by a flat-topped, cylindrical shape. Edges should all be radiused (rounded) for structural resistance to damage. The buoy 50 is not constrained as to shape. Moreover, the buoy 50 may be made to have a comparatively longer length than its diameter.

For example, many buoys are spherical. Others may be cylindrical. One benefit of a longer, more cylindrical buoy 50 extending higher in a vertical direction is visibility at a distance. Particularly where water surfaces 19 are particularly agitated, such as in open bays that have wave action proceeding from the adjacent ocean. The upright subsystem 16 maintains the buoy 50 in a comparatively upright position, not withstanding the wave action of wind-driven waves, wakes of passing watercraft, or the like.

Figure 20A:
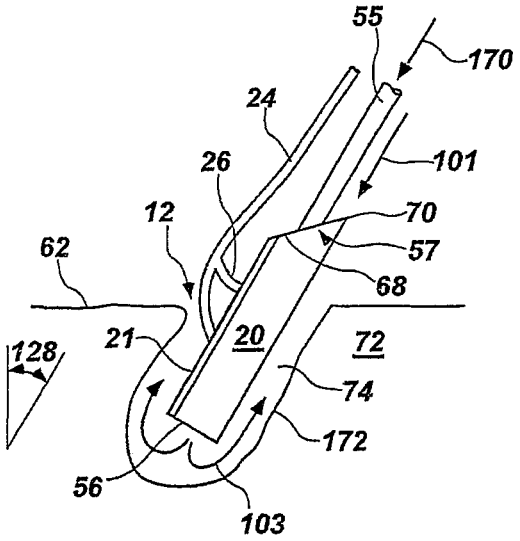
FIG. 20A represents initiation of a drilling process with a pipe driven, hydro-drilling anchor box in accordance with the invention.
Figure 20B:
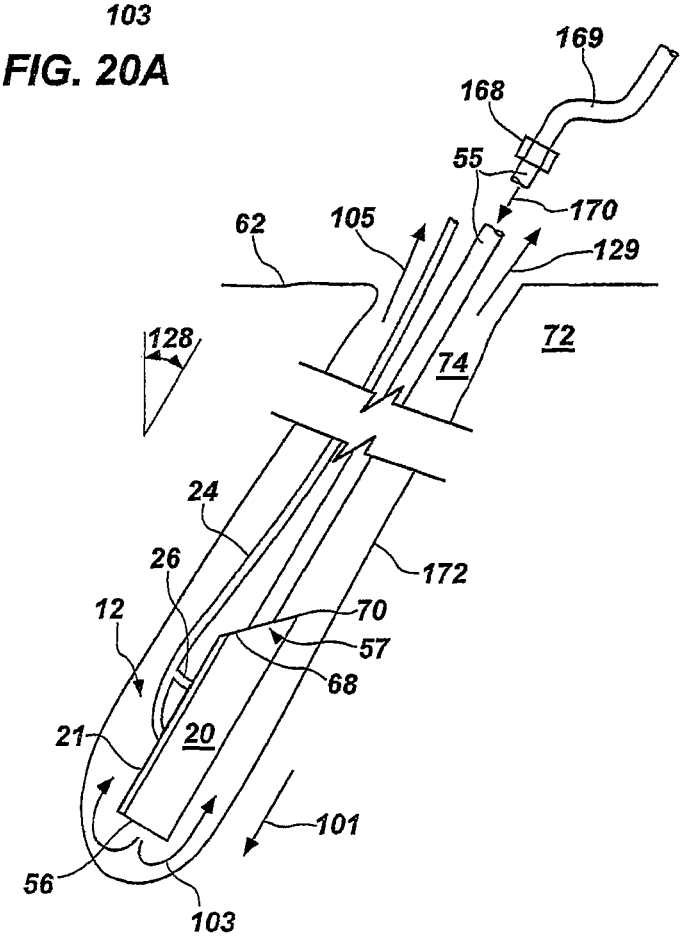
FIG. 20B is a side, elevation, cut away view thereof at a greater depth.
Figure 20C:
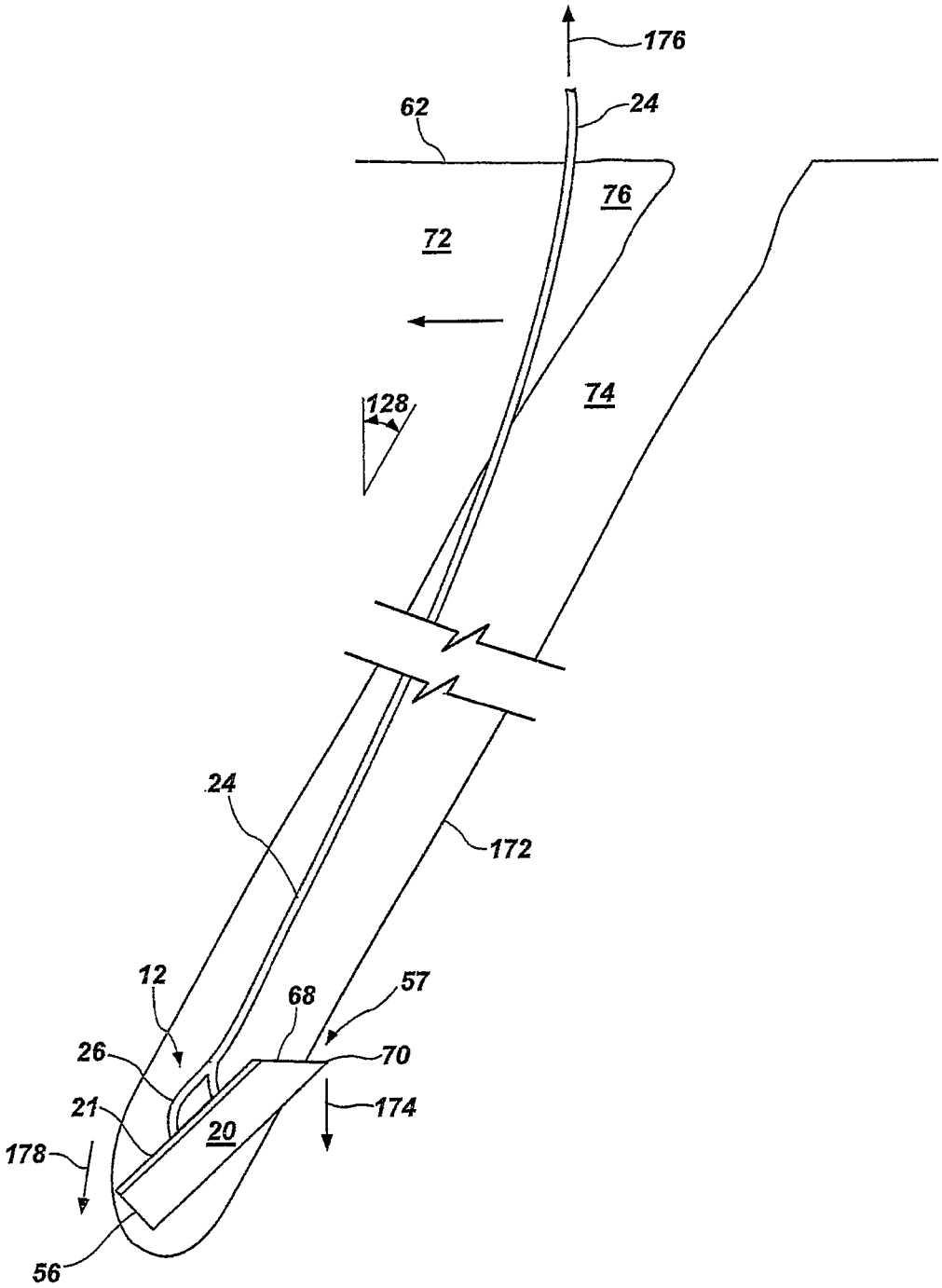
FIG. 20C is a side elevation view thereof at a greater depth, after drilling, upon initiation of the securement and setting steps of a process in accordance with the invention.
Figure 20D:
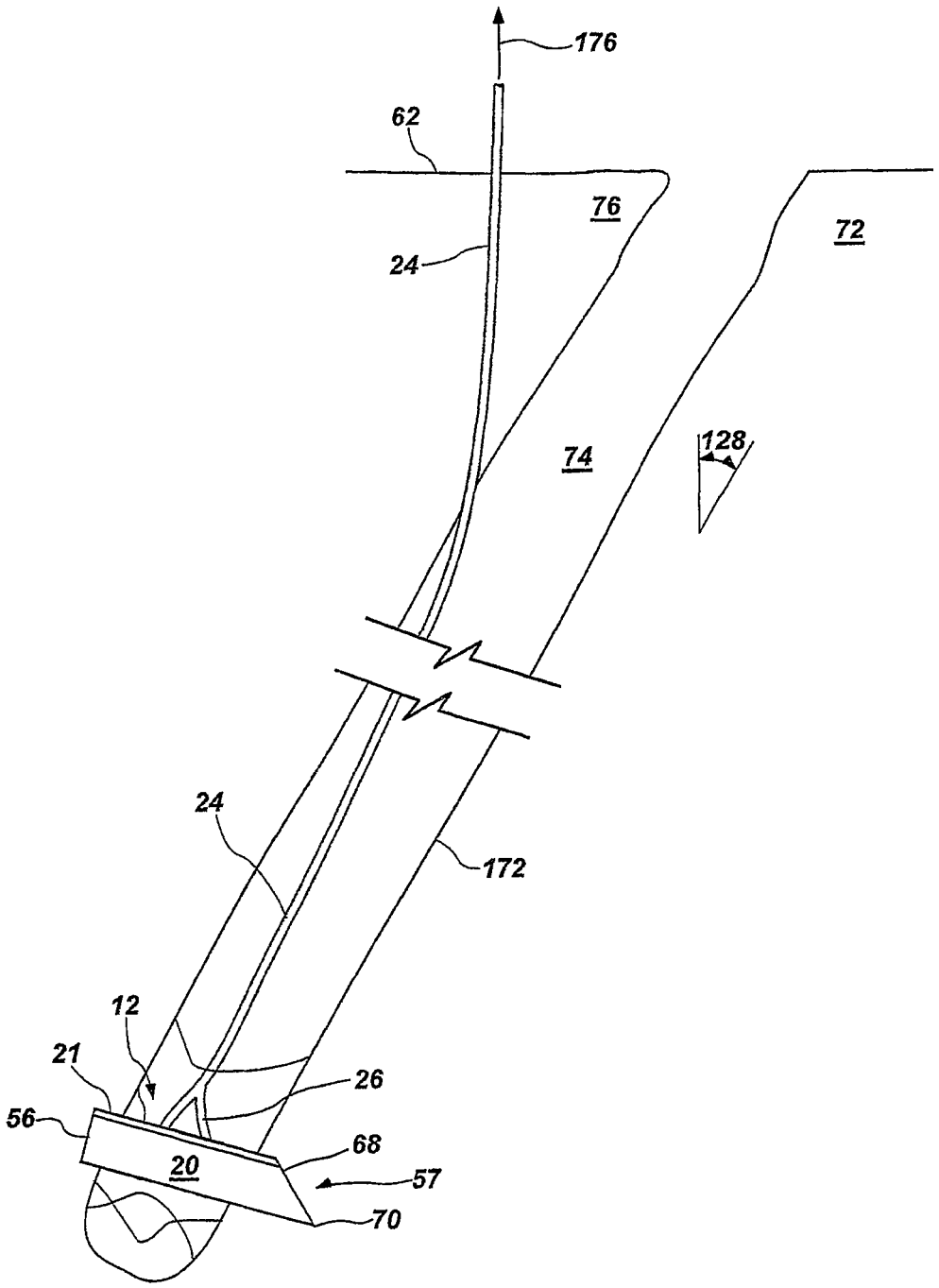
FIG. 20D is a side elevation view thereof with the anchor subsystem fully engaged and securing a rope, line, or other rode into a sea bed.
Figure 21:
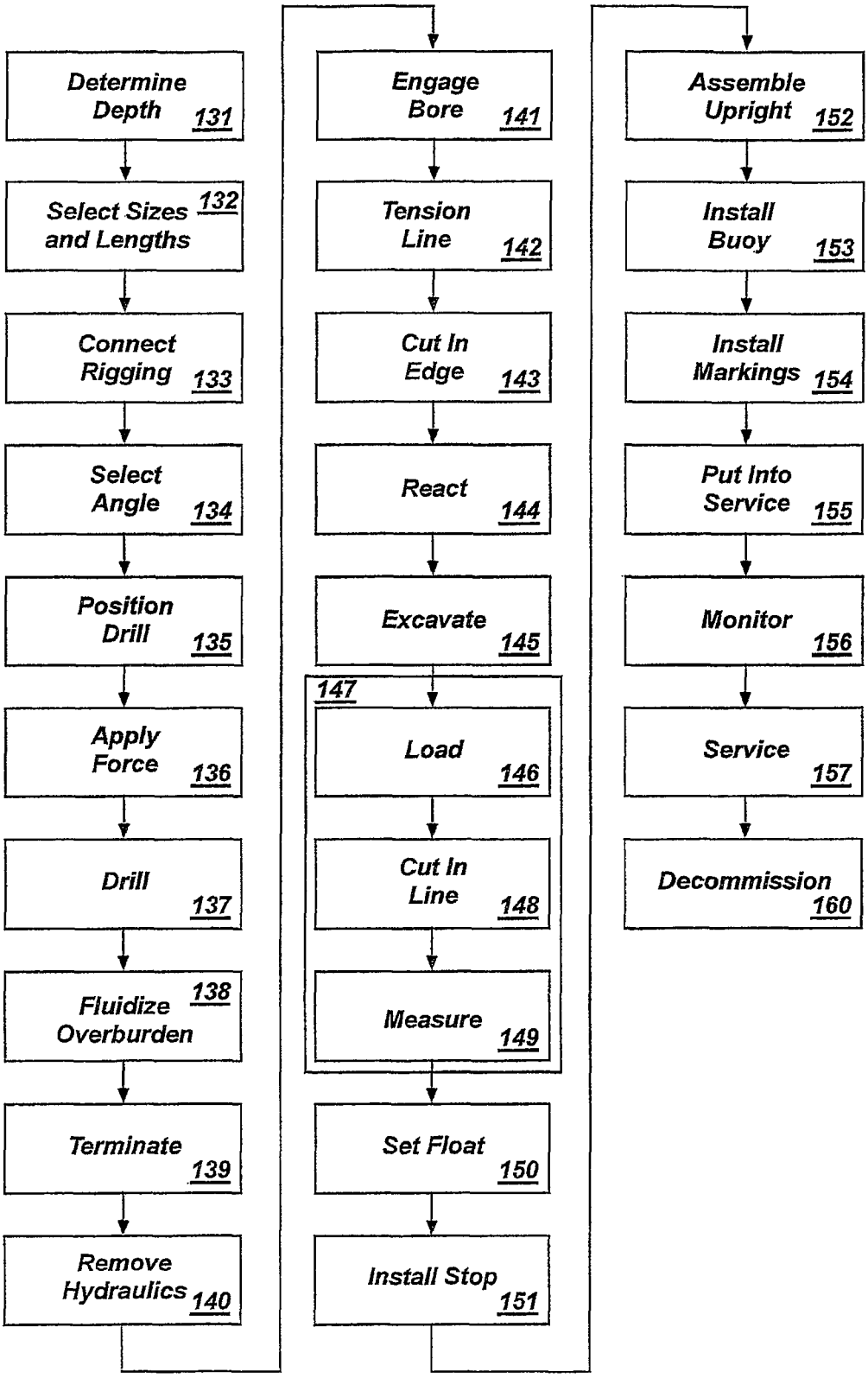
FIG. 21 is a schematic block diagram of a process for anchoring an object, such as a marking buoy, mooring buoy, or the like, in accordance with the invention.

Referring to FIGS. 20A through 20D and 21, a process 130 is illustrated. The installation process 130 is described generally by the various steps of FIG. 21, illustrated by FIGS. 20A through 20D. For example, initially, determining 131 a depth of a surface 62 of the sea bed 72 below the level 19 or surface 19 of the water provides information that will assist in selecting equipment. This may occur either prior to (e.g., by mapping or sounding) or after (e.g., investigating a previously identified site) determining 131 the depth of the surface 62 of the "substrate" 72.

The process of selecting a site, loading a working boat or barge with the proper equipment, pipes, pumps, hoses, fittings, lines, navigation aids, anchors, measurement devices, dynamometers, and the like may be done in any suitable manner. Thus, the process 130 may begin with a working watercraft properly anchored at the location where a system 10 will be installed in accordance with the invention. Thus, determining 131 the local depth may have already been done previously. Determining 131 the depth may be done by sounding with sonar, measuring with a suitable fathoming device, or the like. On site the pipe 55 with suitable markings and the head 20 installed on it may simply be set on the surface 62 of the substrate 72.

Upon determining 131 a depth between a water surface 19 and a surface 62 of the sea bed 72, selecting lengths 132 is appropriate for several items. For example, selecting a length of the line 24 to be used will be important, and whether free ended Likewise, in selecting 132 various lengths, one may determine whether or not to use a single line 24, multiple lines 24, and whether to re-braid any loop 26 on site or to have the loops 26 pre-braided before installation. Thus, in selecting 132 the lengths, it may be important to determine whether other splicing or connecting mechanisms may be appropriate between two separate portions of the line 24.

Likewise, in selecting 132 various lengths of items, it may be important to determine the actual length of the head 20 or crossbar 20 that will be used in the anchor. Different applications or substrates may require or suggest differing values. For example, anchoring a channel marker buoy 50 will not require the "pull-out strength" (force support) required by a mooring buoy 50 associated with a comparatively large watercraft, like working watercraft, tug boats, barges, and the like. Such craft may often be moored to piers in harbors, rather than on mooring buoys 50.

Nevertheless, whether a small, private watercraft under 50 feet (15 meters), or a comparatively larger yacht, e.g., over 100 feet (30 meters), strength of the line 24, and anchor 12, and pull-out force will matter. A 25-foot sailboat has much less strength requirement than does a 50-foot or 100-foot motorized craft to be brought about when reaching the length limit of its line 24. Thus, those considerations may be processed to determine appropriate sizes of the diameter of the line 24, the length of the crossbar 20, and other measurements that exist.

Other sizes that must be selected 132 include is the length and diameter of a water line passing from a pump onboard a working craft to the pipe 55 and into the bore 74. Meanwhile, the length, diameter, wall thickness, stiffness, material, and the like may be specified during selecting 132 the specification for the pipe 55 that feeds and drives the head 20 into the bore 74. In certain embodiments, it has been found advisable to use conventional pressurized, galvanized steel pipe. A diameter of from about 1 inch to about 2 inches has been found suitable. A one to two inch diameter pipe 55 provides sufficient stiffness, and thus may be operable at a typical length at suitable depth and required manipulations. By the same token, a smaller or larger diameter of pipe 55 may be required due to the size of the crossbar 20 or head 20, with its associated threaded opening 59 in the mount 58 or mounting plate 58.

For example, the crossbar 20 or head 20 may be one of several different sizes available, which will suitably have dimensions selected for side wall 104 thickness, bottom wall 102 thickness, top plate 21 thickness, and the like. Thus, the diameter inside and outside of the pipe 55, as well as its length may be selected 132 and coordinated as part of the selection 132 of sizes. Other sizes may be selected 132 as necessary to complete an installation.

In a typical operation, a boat will use one or a limited number of pump sizes, with a suitable mass transport rate (e.g., gallons per minute, pounds per minute, pressure differential, and the like). Likewise, the lines or hoses feeding the pump (not shown) its source water and carrying away the pressurized water may be sized according to the specifications for the feeding and output of the pump. Adapters, quick disconnects, and the like between the pipe 55 and hoses on a pump may be specified for a particular job, or may be standard, and simply be adapted to the pump.

Connecting 133 rigging required may involve connecting 133 the head 20 or crossbar 20 to the pipe 55, connecting 133 the pipe 55 to the system of hoses fed by the pump, connecting 133 the thimble 60 and loop 26 to the crossbar 20, and so forth. These and more may all be included in connecting 133 the rigging.

Connecting 133 may or may not include connecting 133 the line 24 to a test device, such as a dynamometer. A dynamometer may be connected to a reel, which may simply be a permanent part of the equipment responsible to feed out or draw in the line 24 with respect to the working vessel (watercraft, boat, etc.).

Selecting 134 an angle involves the determination of the angle 128 that will be made by the bore 74 with respect to a vertical line rising from the sea bed 72, and specifically the surface 62 thereof. As seen in FIGS. 20A through 20D, the angle 128 may be selected 134, and is typically between 0 and 45 degrees. More particularly, it has been found appropriate to choose an angle of from about 10 to about 25 degrees. A target angle of about 15 to 20 degrees has been shown to be suitable. Up to 30 degrees does not constitute any particular loss of depth corresponding to the length of the bore 74 due to the cosine of the angle 128.

Unlike many conventional buoys, the buoy 50 in accordance with the invention is made of a high density polymeric material, having a sufficiently thick wall to be structurally stiff comparatively robust, and to survive in marine environments, being much more durable than conventional buoys of various types, including standard mooring buoys. Moreover, the buoy 50 in accordance with the invention has the slots 127 or recesses 127 to receive the marking-color stripe 54. Meanwhile, the recesses 127 may receive the marker 52 by way of a strip, individual alphanumeric elements, or the like that are protected and thus remain visible for a suitably long period of time. The lip 125 maintains the markers 52, 54 in place, unlike conventional systems wherein tape or the like is dependent on adhesives that quickly fail and color elements that abrade and leach or bleach out, particularly when positioned directly on the outer surface of the wall 82 of the buoy 50.

Thus, the heavier gauge of plastic, the longer chain polymers, and the like provide a much more durable buoy 50. In some embodiments, the colored marker 54 may be cast in as a color in the buoy 50. Thus, it will not fall off, and may be made comparatively color fast, even in the presence of the sunshine attempting to bleach it.

The recess 42 about the central bore 86 provides a place for the ring 38 to be out of the way, not strike the boat tethered thereto, and otherwise be protected. Due to the recess 42, the ring 38 is not free to move about an outer surface of the buoy 50, and thus scratch the surface of a boat. Moreover, one or more of the ancillary bores 44 may be used to secure an anchor rod to lock a cap over the recess 42, preventing or resisting unauthorized access to the ring 38 of the buoy 50. Thus, the ring 38 will not scratch the watercraft that approaches to make use of the buoy 50. In certain embodiments, the ring 38 may also be supported in a manner that is standing up and easier to access and grab by a boatman seeking to attach a mooring line thereto.

The bores 44 may pass through the entire height of the buoy 50, or may merely be represented as sockets 44, wells 44, blind holes 44, or the like near the outside of the buoy 50. Attachment of locking plates, and the like may simply be done entirely at the top of the buoy 50.

However, with longer lengths for the pair of bores 44, up to and including a through-hole 44, a buoy 50 may hold a banner or a sign that identifies the buoy 50, identifies an instruction or regulation such as a "no wake" condition, or the like. Attached to extend above a buoy 50 will make it more prominent and more easily identifiable as to its function. Also, a pole 46 may be inserted, such as a painter pole 46, quite literally, to hold a painter line.

Meanwhile, the work grip 30 or stop 30 also replaces other metal components such as swivels and the like that are frequently damaged and become inoperative due to corrosion, chafing, a combination thereof, attacked by marine organisms, and so forth.

Moreover, it has been found that the pipe 55, in use, with a crossbar 20 receiving a nominal diameter of about one to two inches. A crossbar 20 having a deck width for the upper plate 21 of about 4 inches, and a total depth of less than 6 inches, from the top of the top plate 21 or top wall 21 to the bottom of the bottom wall 102, creates a bore 74 about 18 inches in diameter, the overall disturbed area, which quickly fills in.

Moreover, the line 24 or rode 24 can be continuous, and includes no metal in the load path. If no knot is required, stresses are reduced within the line 24 from thimble 60 to thimble 95. A midline splice or connection is permissible using thimbles or a bowline, the latter causing de-rating of the line 24 by about 25 to 30 percent.

Another great advantage of a system 10 in accordance with the invention is that it may be installed entirely from the deck of a boat. In fact, some work boats have an upper working deck and a lower working deck. On such a boat, even one of modest length (e.g., 20 to 30 feet), such as a 25-foot working catamaran, has been found that a depth of 20 feet can be easily serviced. Thus, a pipe length of about 20 feet plus water depth has been found suitable for many common marine installations.

Moreover, the drilling process 137 requires no turning elements, no cyclical jackhammer noise, no high power, no hydraulic oil subject to spilling, or the like. Typically, a system 10 may be installed at any depth the pipe 55 will reach.

In experiments, a 20-foot pipe was easily able to cut 20 feet in distance within a period of about 5 minutes. Moreover, anchors were able to support 4,000 pounds of pull-out strength immediately upon setting 150. The necessary equipment is comparatively inexpensive. Notwithstanding a pump is required, the other equipment outside of a standard pipe is comparatively inexpensive, much less than $1,000.00, and may cost only a few hundred dollars. The invention can replace concrete anchors in drillable and soft sea beds 72. Being cost effective to purchase and to operate, the system 10 may effectively replace prior art anchors that are being mandated out of use and out of sea beds 72 by regulatory agencies.

The load is carried exclusively and entirely by the line 24 from thimble 60 to thimble 95 without any submerged, corrodible, load-bearing elements required. Even a splice, thimbles, or other connection between two separate elements forming a single line 24 may be connected by a bowline, which is approved to require only 25 to 30 percent de-rating of a line 24, as a permanent splice. The entire system 10 is shippable by boat, and does not need a specialized craft and winch for installation, transport, or the like. The system 10 may anchor as an embedded element in the sea bed 72, to provide a mooring point easily accessed by a watercraft.

Meanwhile, the line 24 is hidden from ultra violet rays from the sun, and thus is not subject to such UV damage. The rope 24 or line 24 is protected from chafing against any other elements, as it is connected to a thimble 60 or a thimble 95 at its extrema. As to the worm grip 30, the rope 24 does not move with respect to the worm grip 30 in an appreciable fashion except its very edges, and there in a very limited manner. A diameter ratio of 3-to-1 between the arc of each thimble 60, 95 and the diameter line 24 is maintained.

In summary, a line 24, such as polypropylene, braided line may function for thirty years. Thus, a system 10 in accordance with the invention may last that long without alteration. Periodic inspections are simple and straightforward. Abandonment of an anchor can easily be done or it may be removed by re-drilling along the line 24 some distance and cutting the line 24. Extraction is possible. One may enter a sea bed 72 with a drill, having loops anchoring the drill at two or more points on the line 24. The drill operates by following the line 24 downward until exposing the crossbar 20. Of course, this may necessarily interfere with or disrupt more of the surface 62 of the sea bed 72.

Extraction is not necessary. One may excavate (e.g., drill) for some distance below the surface 52, with a minimum amount of disruption, and sever the line 24. Abandoning the site leaves no significant damage to sea vegetation, sea organisms, nor obstructions in fisheries, or the like.

Referring to FIG. 20A, the head 20 has begun initial penetration into the surface 62 of the sea bed 72. The flow 103 from the pipe 55 proceeds out of the threaded opening 58 of the mount 58 or plate 58 at the lead end 56 of the head 20. The jet 103 or flow 103 will accordingly excavate into the material 72 of the sea bed 72, and wash that material upward through the bore 74 to re-settle back down. As illustrated in FIG. 20B, the drilling process will continue, with the flow 103 continuing to move the over burden 72 or the material 72 in the sea bed 72 upward through the bore 74 as a fluidized flow 129, yet very little exiting the bore 74. Fluidization amounts to the fluid drag of the liquid in the flow 103 lifting and separating the particles in the material of the sea bed 72 being carried away from the lead end 56 of the head 20, up the bore 74.

The process illustrated in FIGS. 20A through 20B and FIG. 21 begins with positioning 135 the drill assembly or head 20 with its attached supply pipe 55. Applying 136 force 170 in an axial direction 101 urges the lead end 56 of the head 20 against the bottom of the bore 74. This increases the effective force 170 and pressure applied to erosion of the sea bed 72. As the flow 129 moves the removed overburden or excavated sea bed material 72 away, the pressure drop occurring near the lead end 56 may reduce. If more solid material is encountered, such as clay or a rock, the pressure will increase until the obstruction is moved aside or drilled through.

Accordingly, application of continuing force 170 urges the head 20 further forward or downward in the axial direction 101 to continue excavation. As a practical matter, it has been found that an excavation to a depth of 6 to 8 feet in sedimentary sea beds 72 may actually be done in a period of less than ten minutes, and often from about 5 to about 6 minutes. This does not equate to excavation into large rocks (e.g., head-size), large cobble (e.g., fist-size), or solid substrates (e.g., continuous).

For example, if the sea bed 72 if formed of solid rock, a system 10 in accordance with the invention is not appropriate. However, in such an environment, a more conventional system, such as a solid block or weight may be appropriate. This is because the sea organisms that have grown over the solid rock sea bed 72 will also thrive on the solid surface of a solid weight, such as a concrete weight. However, in gravel, silt comparatively smaller cobble, and various types of movable materials in the sea bed 72, the process 130 illustrated in FIGS. 20A through 21 will be completely appropriate.

Drilling 137 thus takes place as a combination of applying 136 a force 170 in an axial direction 101 while forcing a flow 103 out through the opening 59 in the mount 58 of the head 20. Fluidizing 138 occurs as a consequence of the flow 103 driving the flow 129 carrying the excavated overburden away from the bore face (e.g., outward, etc.).

Terminating 139 the excavation or drilling 137 with typically be done when the pre-marked depth of the pipe 55 reaches a pre-selected value. For example, excavating a distance of about 20 feet will typically be sufficient to suitably anchor a crossbar 20.

Removing 140 the hydraulics is necessary in order to remove the pipe 55. Thus, the pump must be shut down, or the flow of water should be diverted or shut off, and the pipe 55 should be removed from the mount 58. Otherwise, the head 20 or crossbar 20 will remain aligned with the bore 74.

It is important to free the crossbar 20 from alignment with the bore 74 so the edge 70 at the trailing end 57 of the crossbar 20 may engage 141 the wall 172 of the bore 74. Engaging 141 may be stimulated by having eccentric loads on the crossbar 20. For example, the distance from the thimble 60 to the trailing end 57 may be greater than the distance from the thimble 60 to the lead end 56. In this way, any movement of the crossbar 20 in response to tension or urging from the line 24 will tend to tilt the crossbar 20 against the wall 172 to engage 141 the wall 172. Again, in certain embodiments, the top plate 21 of the crossbar 20 may include the edge 70. In other embodiments, it is the bottom wall 102 that will have the edge 70 formed therein.

Upon engaging 141 the bore wall 172, the edge 70 will further respond to tensioning 142 of the line 24. A couple (pair of opposite, rotating forces in engineering) develops. Tensioning 142 the line 24 involves applying a force 176 or load 176 drawing the line 24 upward through the bore 74, urging the crossbar 20 to tilt about the edge 70. Ultimately, as the edge 70 digs into the wall 172 of the bore 74 on one side thereof, the lead end 56 will itself become a blunt, shovel-like instrument also. Both the lead end 56 and the trailing end 57 will tend to dig into the wall 172 of the bore 74, accumulating material thereabove, and penetrating farther and farther into each respective diametrically opposite side of the wall 172.

Thus, cutting 143 by the edge 70 is accelerated or exacerbated by the tensioning 142. Meanwhile, the shoveling reaction of the lead end 56 pivoting about the trailing end 57, under the force of the line 24 applied to the rocker 22 pivots the crossbar 20. This causes the lead end 56 to react to the forces of the trailing end 57 and the line 24. The combination of forces results in a mechanical couple. That is, the trailing end 57 is urged downward by a force 174 of the sea bed 72, while the crossbar 20 is urged upward by a force 176 applied by the line 24 upward.

Eventually, the reacting 144 by the lead end 56 will overcome the force 178 acting on the lead end 56 by the sea bed 72. The ends 56, 57 of the crossbar 20 may penetrate the wall 172 of the bore 74 more easily than pulling upward against the overburden acting on the top plate 21. The crossbar 20 will embed itself within the wall 172 permanently. A certain amount of the overburden will tend to fill the bottom of the bore 74. Meanwhile, over some short period of time, such as a few weeks, consolidation of material in the bore 74 will permanently secure the crossbar 20 thereat.

Referring to FIG. 20D, the installed system 10, and one more particularly the anchor subsystem 12, will look approximately like that shown in FIG. 20D upon completion of setting the crossbar 20. Thus, excavating 145 by the lead end 56 and trailing end 57 is done initially by the edge 70 and the guide or slope 68. However, it becomes substantially universal across both ends 56, 57 of the top plate 21 as the crossbar 20 penetrates the wall 172.

The evaluation of the force 176 may be done during the actual tensioning 142, and excavating 145. During that time, a region 76 adjacent to the bore 74 may be cut into by lateral movement of the line 24 against the sea bed 72. This region 76 or cut-in region 76 may extend all the way down the bore 74 to the crossbar 20. Regardless, the otherwise undisturbed, consolidated, cut-in region 76 provides further assurance that the crossbar 20 cannot rise and will not rise up through the sea bed 72.

In determining whether the set of the crossbar 20 is suitable, the process 130 may include loading 146 the line 24 with a force 176 greater than was required to set the crossbar 20. Thus, further cutting-in 148 by the line 24 may occur as greater loads 176 are applied thereto. In one presently contemplated embodiment, measuring 149 the force 176 effectively measures the "pull-out force" the crossbar 20 must sustain, or will sustain. Typically, a crossbar 20 being installed for service purposes (not solely for testing purposes) will not be tested to failure. Thus, the measuring 149 will be done with a force 176 simply calculated to meet a specification.

Once the installation process is complete, including steps 135 through 145, the testing process 146, including steps 147 through 149, may be conducted. Thereafter or before, one may set 150 a float 28 at a particular depth in the line 24. The stop 30 may have already been installed in the line 24, if a single, continuous piece of line 24 is used. However, if the line 24 is to be spliced or otherwise connected from both a buoy free end to a free anchor end, then the float 28 and stop 30 may both be installed at this time.

However, regardless of when the float 28 and stop 30 are installed, the positioning may be done at the positioning 150 or setting step 150 of the stop 30. Setting 150 is done by threading the line 24 through the float 28 and the apertures 31 in the stop 30 to fix the float 28 at an appropriate depth (height from the floor 62). The principal functions of a mid-line float 28 may be several, including protection of the sea bed 72, the organisms on the surface 62 of the sea bed 72, ready identification presence underwater for the location of the anchor subsystem 12 if a buoy is destroyed or lost, and so forth.

Installing 151 the stop 30 may be done even before drilling 137. For example, the line 24 may already be provided with a float 28 and stop 30 pre-positioned (temporarily or permanently) on the line 24 prior to drilling 137. Nevertheless, if a spliced or connected line 24 is used, formed in two segments, each having a loop 26 at one extremity and a free end near where they will join, then the installation 151 may actually occur after threading the float 28 setting 150 the float 28 in position.

Assembling 152 the upright subsystem 16 may occur at any suitable location or position in the process 130. Again, depending on whether a single segment ore more segments of line 24 are relied upon, the upright subsystem 16 may be assembled 152 partially at different times and locations. For example, one may use two eye splices on the anchor and two eye splices on the buoy line with a line in between with a bowline at each end tied to the anchor line and buoy line.

However, eventually, the column 40 must be secured to the flange 89 or bearing 89, and secured to the housing 94 by the line 24 or by pre-assembly, preferably. Positioning the thimble 95 or cap 95 closing up the housing 94, likewise dependent upon the configuration of the line 24, may involve setting the upper loop 26*b* on the thimble 95 or cap 95. If the thimble 95 is integral with the cap 95, as illustrated, closure of the housing 94 positions the thimble 95 inside the housing 94 otherwise, the thimble 95 may be separate or inside the housing 94. The line 24 will eventually run from thimble 60 to thimble 95 with no intervening metal in the load path. Load is transferred by the thimble 95 to the axle 92.

Once again, depending on whether a single or double line segment configuration is used, installing 153 the buoy 50 may be done at any appropriate time when access is available and convenience is suitable. To accomplish this, the column 40 or shaft 40 that acts as the actual upright member 40 is inserted into the central bore 86 of the buoy 50. The bearing 89 or flange 89 of the upright subsystem 16 sits against the central seat 87 inside the recess 42 at the top of the central bore 86.

Likewise, the weight 34 may be assembled in pieces to close upon the column 40, or may be threaded onto the column 40. Alternatively, it may be threaded onto the column 40 as a single, monolithic collar 34. The collar 34 or weight 34 needs to be secured near the bottom end of the column 40 by a keeper 36 or fastener 36 of some suitable type. A choice of threads, bolts, pins, rivets, or the like is all subject to reliability and securement of the weight 34 in a position. That position is at the lower extremity or proximate the lower extremity of the column 40. This provides maximum leverage against the buoy 50 to keep the buoy 50 upright.

Thus, one may see how the buoy 50 may be installed 153 on the upright subsystem 16 before or after the line 24 is threaded through the upright subsystem 16. Similarly, the portions of the line 24 from the buoy 50 downward may be completely installed after the drilling 137 and excavating 145 is completed, by simply dropping a line 24 down from the buoy subsystem 18, through the upright subsystem 16, to be connected to the line 24 just above the stop 30 and mid-line float 28. Alternatively, the float 28 and worm grip 30 may be above a splice or connection to the lower segment of the line 24.

Installing 154 the markings 52, 54 or labels 52, 54 on the buoy 50 may be done at any suitable time. In the illustrated embodiment, the recesses 127 in the buoy 50 protect the markers 52, 54 or markings 52, 54 against damage. In the illustrated embodiment, installing 154 may involve sliding, deflecting and positioning, or otherwise working with the markers 52, 54 to place them into the recesses 127. The recesses 127 may include a lip 125 above and below in order to secure the markers 52, 54 therein. An interruption in the lip 125 may provide access to slide a marker 52, 54 circumferentially into a recess 127.

The system 10 may next be placed 155 into service, after which it may be monitored 156 and serviced 157 periodically. For example, servicing 157 may involve inspections, replacement of parts, repair of parts, removal of marine growth, and so forth up until such time as the system 10 may be decommissioned 160.

Thus, an apparatus and method in accordance with the invention solve numerous problems. For example, over recent decades, regulatory agencies who process permits for mooring buoys in bodies of water have conducted comprehensive studies of mooring buoy installations. One purpose is to determine the impact on the local environment, plants, animals, or other conditions, such as access to fisheries, or the like. Another purpose is to develop information suitable for designing mooring buoys that may be properly approved and permitted in a particular location.

However, one difficulty with conventional studies and their subject mooring systems is their failure, largely, to take into account the longevity of a system. Thus, certain standard installations demanded by regulators and available at present will only survive in operation from about 2 to about 5 years. Thereafter, they must be rebuilt, removed, reworked, or otherwise modified at considerable expense. Many must be completely replaced. Some may be rendered difficult to replace or remove, and are simply replaced by another installation nearby, and the original is not removed. Note that the observed lifetimes of components and constructions of the inventions described hereinabove extend many years, with ropes lasting underwater for decades.

Moreover, regulatory requirements and compliance are continually in a state of flux. In an apparatus and method in accordance with the invention, years of working with and observing the functionality and longevity of components in a marine environment are coupled with requirements of regulatory agencies, and performance desires from users and suppliers of such marine mooring systems. Accordingly, an apparatus and method in accordance with the invention satisfies virtually all regulatory requirements, in places where it can be installed. With the exception of "impervious substrates" such as large rocks, boulders, or solid rock, a system 10 in accordance with the invention is appropriate. Moreover, for the general public and its uses, all the components of the system 10 described herein far outlast existing installations using currently available technology.

For example, a standard boat anchor is made of metal that will corrode. Moreover, a standard boat mooring structure is made of metal or concrete. Even the concrete may contain metal. Typically, a section of chain is needed on a buoy to keep the rode (line, tether, etc.), low with respect to the sea bed 72. Typically, a comparatively long line 24 or rode 24 is needed to give the proper scope or movement to a watercraft. A comparatively longer rode 24 will have a macro growth of algae which may shade existing bottom vegetation. Moreover, as a rode 24 or line 24 moves with wind and tides, the sea bed 72 may be impacted by erosion or destruction. Here, the shortest distance possible is all that is required by these inventions, minimizing such shading. The more nearly vertical a rode 24 must lie or hang, the less horizontal shading imposed thereby.

Also, historically, a very common anchor system, perhaps the most common, is a concrete block with the shank of a metal eye bolt cast into it, or made of a loop of rebar or the like. Such are still used today, by both public and private entities. However, all cast-in metal components will corrode, leaving the anchor element or concrete block useless. At that point, the anchor block is typically discarded and left on the surface 62 or floor 62 of the sea bed 72. That footprint influences the sea bed 72 and the plant and animal organisms on its surface 62. Soft substrate habitat is displaced wherever a hard concrete block is abandoned. This will displace vegetation that thrives on a soft substrate with vegetation that thrives on a hard substrate. Certain vegetation is protected under the Endangered Species Act (ESA). Thus, various regulatory agencies having a responsibility therefor are moving away from permitting hard (concrete block) anchors.

Thus, abandoned blocks displace a certain amount of existing sedimentary habitat. A hard substrate, such as solid rock is not affected as much. This is because organisms that thrive on a solid substrate or hard substrate 72 will thrive on an abandoned concrete block. Here, in a system 10 and method 130 in accordance with the invention, only the line cross-sectional area remains at that surface 62. A concrete block works by virtue of its weight, typically on the order of about 4,000 pounds (1,800 kilograms) rather than gripping into the surface 62 of the sea bed 72 as does a boat anchor. Here the anchor subsystem 12 for most watercraft weighs under 25 lbs. (10 kg.).

To dispense with the reliance on the cast-in eye bolt, certain concrete block configurations simply include a tunnel. This tunnel passes a line 24 or rode 24 into a passage, below the surface of a concrete block, and out an exit port. This type of anchoring system or block leaves no metal to corrode. When properly installed, these do not wear out readily. However, regulatory agencies are beginning to disallow such systems due to the impact of the footprint (several square feet, typically about 3 feet wide by 4 or 5 feet long, of hard substrate footprint). Thus, in a soft substrate environment, such a block-type anchor displaces soft substrate vegetation with a hard substrate inviting hard substrate vegetation into the habitat. Currently, regulatory agencies are attempting to disallow concrete block anchor types without a showing of a reason why some other, less damaging anchor cannot be used. An apparatus and method in accordance with the invention remedies those ills.

A helix anchor is effectively a screw, appearing something like an ice fisherman's auger. Such a helical screw may be used as an embedded anchor, worked into various substrate types. However, it has the difficulty that it cannot be screwed into rockier or rock substrates. It can be worked into smaller "cobble" substrates. It is typically installed in a manner that measures the load on the powerful, rotating hydraulic motor driving the screw into place. Upon encountering too much back pressure in the hydraulic system, the anchor is deemed to have penetrated as far as it allowed to penetrate. This simply measures resistance to its ability to rotate.

Another problem with such systems is that they must be made of a strong metal, such as steel or iron, which will typically corrode readily in the marine environment. Moreover, inspectors are unable to recognize whether an anchor of this type is corroding below the surface 62 of the sea bed 72. Thus, there is no reasonable mechanism for determining when to replace an anchor, short of catastrophic failure. Here, the system and method of the invention may be pull tested anytime and replaced with ease and minimum environmental impact.

Finally, driven embedded anchors are available. Using a "jack-hammer" type of mechanism one drives an anchor into the sea bed 72, beginning at the surface 62 thereof. However, such systems still leave metal under the sea bed, and at the sea bed surface. Thus, there is still metal subject to corrosion within the water, and uninspected components therebelow.

Such systems do not have a suitable, simple, elegant, and serviceable way to connect the rode 24 to the anchor. Moreover, the underwater jackhammer with its specialized equipment is dangerous, and its operation is unhealthy as it creates a continuing cyclical pressure wave propagated from the driver or jackhammer into the water, and directly against the body, and particularly into the ears of a user.

Perhaps the greatest limitation is the level of training required and the danger to a workman installing such a system. High powered, high pressure, large-force-bearing systems are at work. It is unsafe for an individual worker to be operating such a system underwater alone. Moreover, it requires specialized equipment to handle, adding weight, energy, complexity, safety, and so forth as major concerns. Here, the systems and methods require no large power sources or torques, which can be especially dangerous underwater. All installation operations can be done from a boat.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method for anchoring a buoy, the method comprising:

providing a body defining a longitudinal (axial) direction, a radial direction, and a circumferential direction, all mutually orthogonal to one another, a top end, a bottom end, and an outer surface;

providing the body, further comprising providing the outer surface extending continuously in the circumferential direction, and varying in radius along the axial direction between a relief radius in a relief region and a shielding radius, greater than the relief radius, in a shielding region;

providing the body further comprising providing a passage characterized by a passage perimeter extending continuously in the circumferential direction and extending from the top end to the bottom end;

providing an upright extending through the passage in the axial direction from below the bottom end to a point proximate the top end, reachable by an operator from a watercraft, the upright being selectively positionable to drop through the body to suspend from proximate the top end;

applying markings to the relief region to be protected by the shielding region against contact by objects outside the body;

providing a capture secured to the upright, proximate the top end;

deploying an assembly of the body, upright, and markings;

capturing, from a watercraft, the capture;

lifting the upright through the body by lifting the capture;

linking a mooring line from the watercraft to the capture; and drawing the mooring line to the body by dropping the upright through the body.

2. The method of claim 1, comprising providing a flange leaving the upright free to move axially with respect to the body, limited by the flange against descending completely through the passage.

3. The method of claim 2, comprising providing a collar leaving the upright free to move axially with respect to the body, limited by the collar against ascending completely through the passage.

4. The method of claim 3, further comprising applying a weight proximate the collar, to urge the upright axially downward through the passage.

5. The method of claim 4, further comprising:

providing a thimble proximate the flange;

providing a buoy line extending through the upright to pass continuously about the thimble to secure thereto; and securing the buoy line to an anchor system anchored with respect to a sea bed therebelow.

6. The method of claim 1, further comprising:

providing a pole having a handle end and a hook end; and attaching the handle end to be supported by and secured to the body.

7. The method of claim 6, comprising:

maneuvering a watercraft proximate the body;

removing the pole from the body;

extending the hook end to engage the capture; and drawing the upright toward the watercraft by the pole.

8. The method of claim 6, comprising replacing the pole in the body.

9. The method of claim 8, comprising securing the pole, proximate the handle end to the body by a mechanism selected to rigidly secure the pole to extend upward axially and rigidly from the body.

10. The method of claim 1, comprising:

providing a head, having a lead end and trailing end, the head being secured to a source of water pressurized above the pressure of the ambient water feature at the floor;

securing an anchor rode to the head;

ejecting the pressurized water from the lead end;

drilling, by the pressurized water exiting the head, a bore in the substrate for a pre-selected distance;

removing the source of pressurized water;

digging the head into the bore by drawing on the anchor rode to pivot the head;

leaving the head in the bore; and connecting the buoy line to the anchor rode.

11. A buoy comprising:

a body defining a longitudinal (axial) direction, a radial direction, and a circumferential direction, all mutually orthogonal to one another, a top end, a bottom end, and an outer surface;

the body, having an outer surface extending continuously in the circumferential direction, and varying in radius along the axial direction between a relief radius in a relief region and a shielding radius, greater than the relief radius, in a shielding region;

the body further comprising a passage therethrough characterized by a passage perimeter extending continuously in the circumferential direction and extending from the top end to the bottom end;

an upright extending through the passage in the axial direction to pass from the bottom end to a point thereabove accessible by an operator from a watercraft, the upright being selectively positionable to drop through the body to suspend from the top end;

markings on the relief region positioned to be protected by the shielding region against contact by objects outside the body;

a capture secured to the upright, proximate the top end, to engage a pole extending from a watercraft;

a thimble secured to the upright, proximate the top end to hold a buoy line passing up through the upright from an anchored location therebelow; and the upright being selectively movable longitudinally through the body between a lower position with the thimble proximate the body and a higher position proximate the watercraft to secure a mooring line from the watercraft to the buoy line.

12. The buoy of claim 11, comprising a panel containing the markings, the panel being inserted into the relief region.

13. The buoy of claim 12, wherein the upright comprises:

a tube having a length providing leverage against the body;

a flange at a first end of the tube restraining the tube against the flange descending below the a location proximate the top end;

a collar at a second end of the tube; and a weight, selected to maintain upright the body by relying leverage provided by the tube, the weight being secured to the tube proximate the collar.

14. The buoy of claim 13, comprising a seat portion formed in the body proximate the top end and fitted to bear the flange axially and permit rotation therebetween in the circumferential direction.

15. The buoy of claim 14, comprising a housing containing the thimble and securing the capture thereto to pivot with respect thereto.

16. The buoy of claim 15, further comprising a socket formed in the body and a pole, removably secured in the socket for storage, and removable for use, the pole characterized by a handle end and a capture end to draw the upright axially through the body.

17. The buoy of claim 16, wherein:

one of the catch and the capture forms a loop, and the other thereof forms a hook receivable in the loop;

the pole is sized to extend from the body to a height accessible to a person on a watercraft thereabove for removal and use; and the pole is sized to reach down from a person on a watercraft to draw the capture up to the person for securement to a mooring lead secured to the watercraft.

18. The buoy of claim 17, wherein:

The buoy line, thimble, housing, upright, and body define a load path to an anchor on a sea bed therebelow; and all materials in the load path from the buoy line to the sea bed are non-corrodible materials.

19. The buoy of claim 18, wherein the relief region is formed as a slot having a lip extending axially to form an undercut receiving a panel, containing the markings, sliding in a circumferential direction thereinto and resisting motion of the panel in the axial direction and the radial direction.

20. The buoy of claim 11, further comprising:

a head, having a lead end and trailing end anchored into the seabed by pivoting thereinto;

an anchor rode secured to the head;

a mid line float secured to at least one of the line and the anchor rode between the anchor and the body;

the head, anchor rode, mid line float, upright, and body being formed entirely of non-corrosive materials; and fittings formed exclusively of non-corrodible materials to connect the anchor, anchor rode, mid line float, upright, and body along an entire load path from the sea bed to the capture.

* * * * *